US012241212B2

(12) United States Patent
Crocker et al.

(10) Patent No.: US 12,241,212 B2
(45) Date of Patent: Mar. 4, 2025

(54) GRINDER TRUCK

(71) Applicant: Waterblasting, LLC, Stuart, FL (US)

(72) Inventors: James Crocker, Stuart, FL (US); Stephen Carroll, Stuart, FL (US)

(73) Assignee: Waterblasting, LLC, Stuart, FL (US)

( * ) Notice: Subject to any disclaimer, the term of this patent is extended or adjusted under 35 U.S.C. 154(b) by 1033 days.

(21) Appl. No.: 17/072,638

(22) Filed: Oct. 16, 2020

(65) Prior Publication Data

US 2021/0114122 A1 Apr. 22, 2021

Related U.S. Application Data

(60) Provisional application No. 62/923,091, filed on Oct. 18, 2019.

(51) Int. Cl.
*E01C 23/09* (2006.01)
*E01C 23/088* (2006.01)

(52) U.S. Cl.
CPC ..... *E01C 23/0946* (2013.01); *E01C 23/088* (2013.01)

(58) Field of Classification Search
CPC ..... E01C 23/088; E01C 23/0946
See application file for complete search history.

(56) References Cited

U.S. PATENT DOCUMENTS 3,767,262 A * 10/1973 Pentith ..... E01C 23/088 37/189
5,115,796 A * 5/1992 Schweickhardt .... B23D 61/026 451/542
5,421,669 A * 6/1995 Bertrand ..... E01C 23/0946 404/90
2002/0192025 A1* 12/2002 Johnson ..... E01C 23/088 404/75
2008/0153402 A1* 6/2008 Arcona ..... B24B 49/04 451/352
2013/0277076 A1* 10/2013 Ley ..... E01C 23/026 74/609
2015/0132059 A1* 5/2015 Johnson ..... E01C 11/24 404/94
2016/0340843 A1* 11/2016 Laclef ..... E01C 23/0993
2017/0009408 A1* 1/2017 Marsolek ..... E01C 23/065
2018/0010306 A1 1/2018 Tarmann
2018/0371711 A1 12/2018 Crocker

FOREIGN PATENT DOCUMENTS

EP 3266935 1/2018

OTHER PUBLICATIONS

Capture from youtube : Cat® Next Gen Dozer Monitor: Slope Assist Increment Decrement available at https://www.youtube.com/watch?v=bM7EmYkQwQ4 (Year: 2019).*

* cited by examiner

*Primary Examiner* — Janine M Kreck
(74) *Attorney, Agent, or Firm* — McHale & Slavin, P.A.

(57) ABSTRACT

A grinder truck with a computer controlled profiler in combination with a vehicle automated guidance system for guiding a vehicle and equipment secured to a vehicle for removing of road markings. The computer controlled profiler detects the position of one or more grinding, grooving, rumbling heads in the X, Y and Z position. A controller and one or more actuators are manipulated in response to ground markings visible in a camera field. A remote controller allows an operator to control grinder heads individually, and allows for precise adjustment based upon an operator's visual inspection.

12 Claims, 41 Drawing Sheets

GRINDER TRUCK

CROSS REFERENCE TO RELATED APPLICATION

In accordance with 37 C.F.R. 1.76, a claim of priority is included in an Application Data Sheet filed concurrently herewith. Accordingly, the present invention claims priority to U.S. Provisional Patent Application No. 62/923,091, filed Oct. 18, 2019, entitled "GRINDER TRUCK", the contents of which is incorporated herein by reference.

FIELD OF INVENTION

The present invention generally relates to mobile vehicles and, more particularly, to a grinding, grooving and rumbling vehicle having a computer controlled profiling system for accurate equipment positioning.

BACKGROUND INFORMATION

Road surface markings provide guidance information to both drivers and pedestrians. Markings include, for instance, yellow cautions, white edge of road lines, turn signal lines, reflective markers, and so forth. Road surface markings vary in form, but are all designed to improve safety for those traveling over the roadways.

Marking devices may also be raised or recessed into the road surface, and can either be reflective or non-reflective. Most mechanical road surface markings are permanent; however, some are movable. Botts' dots are generally used to mark the edges of traffic lanes, providing tactile and auditory feedback to vehicle drivers who cross them. Rumble strips are employed and typically consist of a series of troughs that are ground into the asphalt roadway. Rumble strips can be use to warn of hazards of not staying within a specific lane and can create a strong vibration and sound to alert vehicle drivers. Reflective markers are used as travel lane dividers to mark the median or to mark exit slip-roads. By incorporating a raised retro-reflective element, reflective markers are more visible at night and in inclement weather than standard road marking lines.

Non-mechanical markings include, but are not limited to paint, thermo-set, tape, and thermoplastic pavement markings. Paint, which sometimes includes additives, such as retro-reflective glass beads, is generally used to mark travel lanes, spaces in parking lots or special purpose spaces for disabled parking, loading zones, or time-restricted parking areas. Paint is a low-cost application.

Thermoplastic has become one of the most common types of road surface markings based on its balance between cost and performance longevity. Thermoplastic is durable, easy to apply, and can be made to be reflective. The longevity of thermoplastic makes it a very cost effective traffic delineation solution. The use of thermoplastics over paints has increased mainly due to the performance benefits of increased durability and retro-reflectivity. Furthermore, municipalities can budget for a thermoplastic replacement marking every few years instead of having to budget for paint striping every year or less.

When surface markings are to be replaced and renewed, one method of surface marking removal is by use of a vehicle having a grinder head. A grinder head is capable of deep impact cuts into the road surface by forming rumble strips or minimal surface impact for removal of thermoplastic markings without damaging the road surface. In order to guide a vehicle having a grinder head, prior art utilizes a trained operator who may be assisted by a video camera to steer the vehicle to control the grinder head along a proper trajectory. This often requires significant experience and talent to efficiently remove the markings in a single pass without damaging the roadway.

What is needed in the art is an improved grinder truck including a computer controlled profiler for positioning and controlling the grinder heads to provide precise surface markings removal, increase vehicle efficiency, and reduce the need for highly skilled operators.

SUMMARY OF THE INVENTION

Briefly, one embodiment of the invention involves a computer controlled profiler for use in combination with a vehicle automated guidance system for guiding a vehicle and equipment secured to a vehicle for removing of road markings. The system includes a camera, a controller and one or more actuators that are manipulated in response to ground markings visible in the camera field. This allows the vehicle or the equipment secured to the vehicle to be positioned in real-time as the vehicle progresses. A remote controller allows an operator to control grinder heads individually, which allows for precise adjustment based upon an operator's visual inspection. The computer controlled profiler detects the position of one or more grinding, grooving, and rumbling heads in the X, Y and Z position. The grinding head takes feedback from vertical and horizontal linear actuators that have an internal encoder so as instruct the computer where the cylinder is positioned. A rotary encoder sits against a vehicle tire to detect motion.

An objective of the invention is to disclose a single operator grinder vehicle having up to two heads on each side of the vehicle facilitated by automatic guidance as well as the master/slave software implemented on the vehicle. The self-guided road marking system is capable of steering a piece of equipment secured to a vehicle to follow a preexisting road marking.

Still another objective of the invention is to provide a device for precise depth control of a grinder using a cylinder technology integrated into the grinder head carriage.

Another objective of the invention is to provide a bump or tap for incremental movement of the grinder head for left, right, up, down movement of a grinder head.

Yet still another objective of the invention is to provide a remote control device allowing an operator incremental control of the grinder head from a remote position.

Another objective of the invention is to disclose the use of a grinder vehicle with one or multiple rotary lobe high vacuum blowers for improved debris collection, including the picking up of RPM's and the elimination of dry filtration methodology on such vehicles.

Another objective of the invention is to disclose an air broom using positive air pressure to provide a sweeping action behind a vacuum pick-up. Using air to stir up any dust that might have been left remaining and cycling it back through the vacuum system. The positive air pressure is received from the grinder vehicle vacuum blowers exhaust air, providing positive air after a silencer, and re-inserting air into the sweep, for a sweeping action.

Still another objective of the invention is to disclose a scissor dump that includes a chute that is closed until the container is raised into position, wherein the chute is opened for dumping.

Yet still another objective of the invention is to disclose a reflector popper-upper that employs a pulsated clearance door. A computer controls the pulse links and the timing between each pulse.

Still another objective of the invention is to incorporate high negative pressure and water mixology at the entrance into a vacuum tank.

Another objective of the invention is to provide a grinder head having a configuration that allows for the ability to expose the cutting teeth of the grinder head for ease of maintenance, without the use of tools.

Still other objective of the invention is to teach the use of a debris mixer for placing road debris in suspension, allowing for ease of vacuum removal.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION

Figure 1:
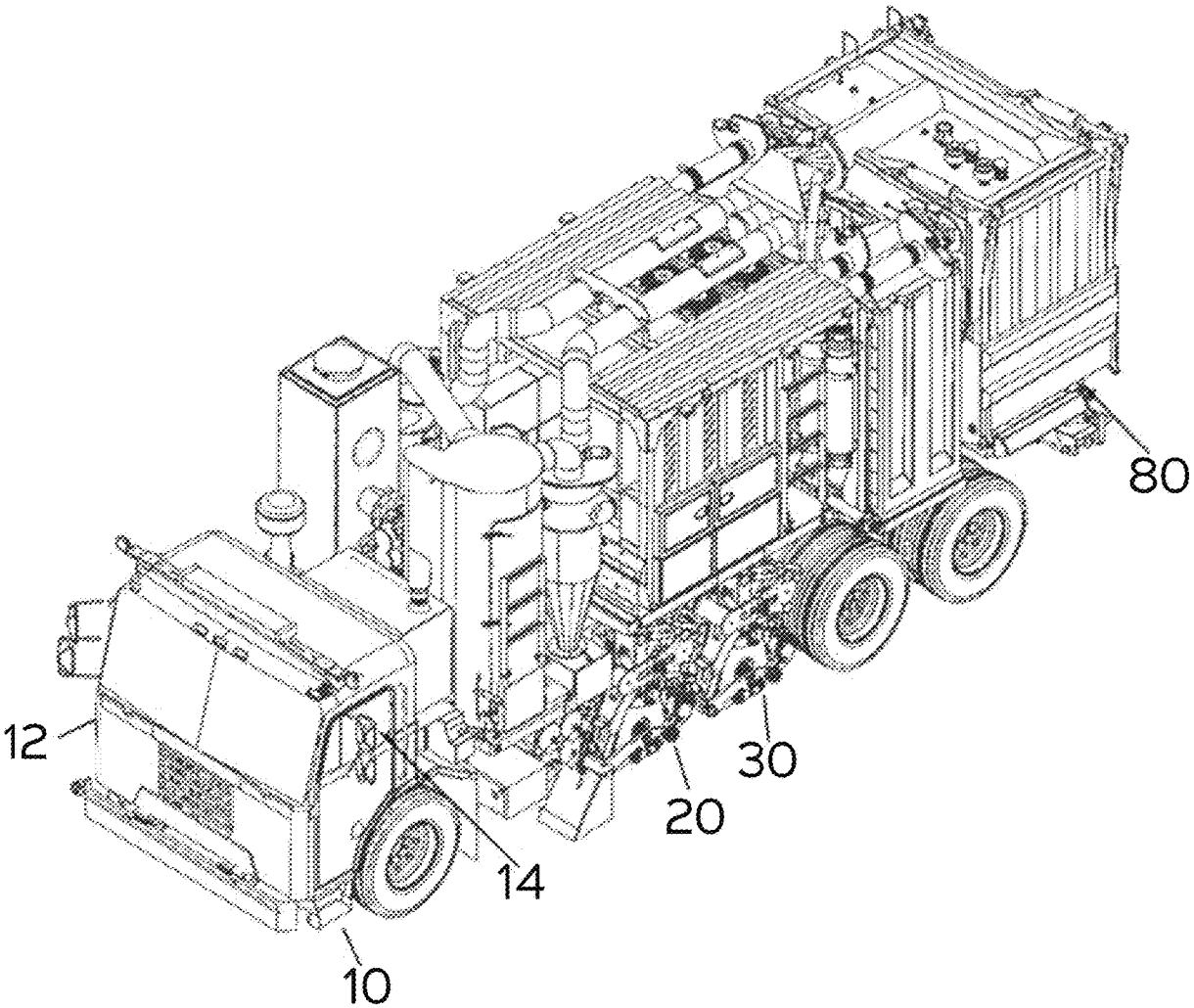
FIG. 1 is a perspective view of the Grinder Truck.
Figure 2:
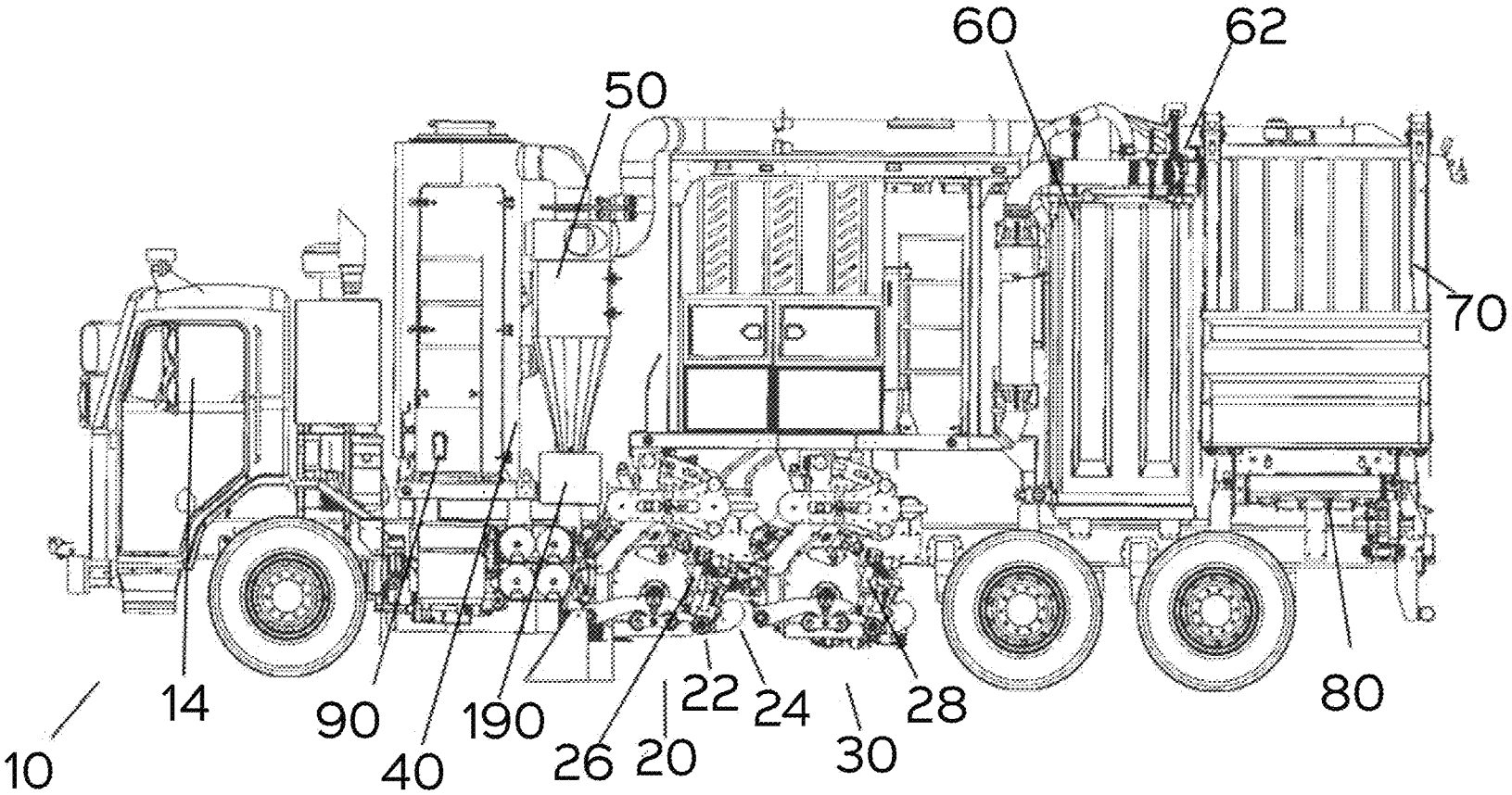
FIG. 2 is a side view thereof.

While the present invention is susceptible of embodiment in various forms, there is shown in the drawings and will hereinafter be described a presently preferred and alternative embodiments with the understanding that the present disclosure is to be considered an exemplification of the invention and is not intended to limit the invention to the specific embodiments illustrated.

Referring to FIGS. 1-4, illustrated is the grinder truck 10 of the instant invention. The truck 10 has a cab 12 having a display screen location 14 for use of the computer controlled profiler described herein. Mounted to the truck 10 is grinder one 20 and grinder two 30. A reflector popper-upper 22 is illustrated and, in this embodiment, an air broom 24. Grinder one 20 employs a first smart cylinder 26 and grinder two 30 employs a second smart cylinder 28.

Rotary lobe high vacuum blowers 40 and mixing cyclone 50 interface with vacuum tank 60 with a high negative pressure and water mixology 62 at the entrance to the vacuum tank 60. A debris container 70 is raised by a high dump with scissor jack 80.

Referring now to the figures in general, and specifically to FIGS. 5-21. A first embodiment is directed to a computer controlled multi-purpose grinder head that provides a grinder, groover, rumbler and the like functional device. The computer provides profiling to the device in the x, y and z position, allowing accurate positioning to grind markings off roadways. For recessed pavement markings, the device will cut grooves in the roadway to provide marker protection against snowplow and wintertime conditions. For instance, the device may be used to cut ⅛" or 3⁄16", depending on what the spec is, using a variety of diamond or carbide cutting teeth in order to put certain profiles in the roadway. The computer control system knows the exact positioning of one or more grinding, grooving, rumbling heads in the x, y and z position, as it takes feedback from linear actuators that are attached to the device and from internal encoders, so the cylinder advises the computer as to its actual current position.

The linear position of the vehicle itself, for one axis, is determined by a rotary encoder that is attached to a rotary housing. The encoder is formed from a 3/16" piece of aluminum cut in a circle and attached to the encoder for placement against the rear wheel of the truck. The encoder provides an accurate position as to where the vehicle is linearly along the roadway by taking the diameter of the wheel into consideration. A vertical cylinder is used to determine the vertical grinding head position in the up and down relationship, and a horizontal cylinder is used to determine vehicle left and right position in relation to a drip line or an expansion joint. Left, right position is determined by the operator using a contrast sensor camera that extends from the truck using a camera cross-hair generator, which allows the operator to extend the camera to where the drip line or the expansion joint in the pavement is visible. The operator can extend the grinding head for proper positioning over the top of the line. When the cross-hair and grinding head is placed over the top of the line, the operator can focus on the cross-hair on a display screen, not the grinding head. The operator is able to keep the cross-hair on the display screen, which keeps the head positioned over the top of the line. Should the operator misalign the cross-hair, the computer controller allows the operator to tap to a new location. The computer provides pre-set moves with a tap on the display screen, for example: a 1/16", 1/8", 1/4") with X number of taps to move the grinder head in or out as needed. The system employs a telescoping cylinder to make the changes.

The grinder head can be programmed to produce any sort of pattern or profile. For instance, a cutter head can be installed on the vehicle to perform plunge cuts. In this example, the vehicle comes to a complete stop, the vertical cylinder plunges into the pavement a pre-determined depth (e.g. 3/4" and, when the cutter head lifts out from the ground, there is a vacuum attached so that all the dust, dirt and any water is removed, leaving a depression in the road that would exactly fit a road marker. In this example, once the plunge cut is complete, then another vehicle inserts the road marker. The vehicle can be programmed to travel a fixed distance between depressions using a highly accurate hydrostatic pump that can ramp to a certain speed, or slow down over a certain given number of seconds so that the movement is not jerky and sudden, but rather smooth and controlled, bringing the vehicle to a stop at a very precise moment. Once the vehicle is stopped, the computer senses that the encoder is no longer moving, and can begin the vertical cylinder plunge. The vertical cylinder knows where the road is, the pre-determined depth that the profile demands, and the moment that the cutter has reached the depth. The vertical cylinder can be set to linger for seconds to make sure that the material is fully cut, and then raise at a given speed, the speed and feed of all being controlled by the computer, including the vertical ?, the horizontal ?, the linear speed of the vehicle, the speed of the actuators, the position of actuators, and so forth.

Figure 3:
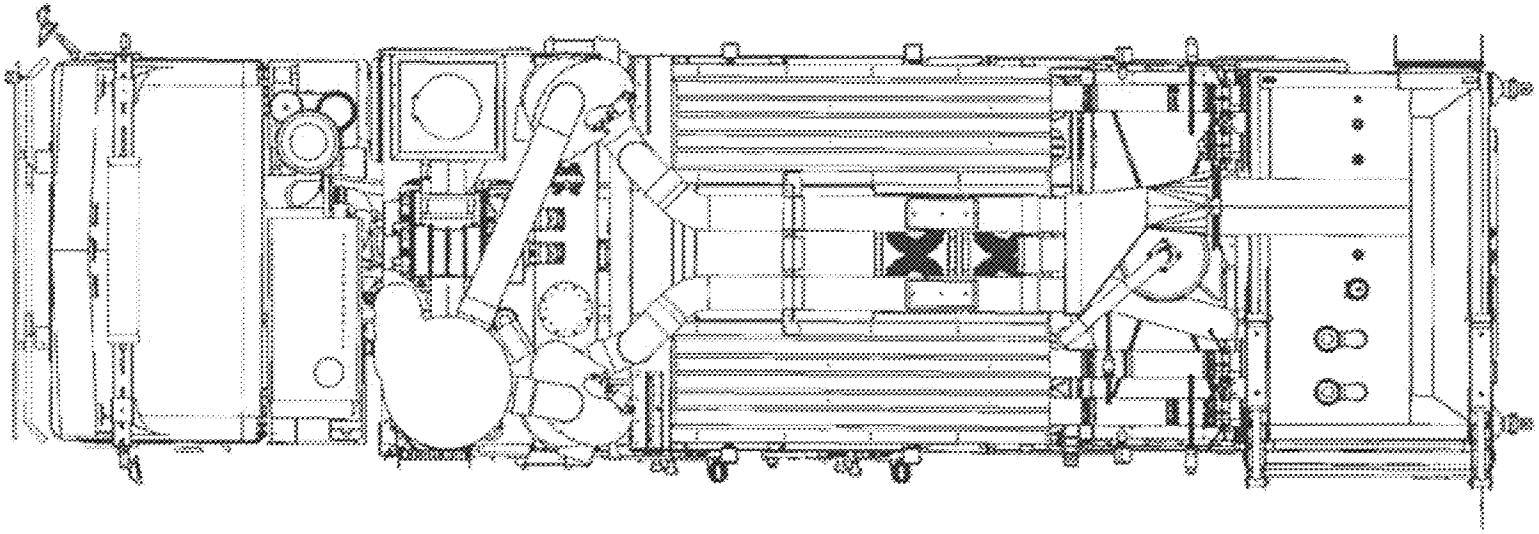
FIG. 3 is a top view thereof.

FIG. 3 is a screen display of the computer controlled profiler illustrating the position of up to four heads, including individual control of each head. Control allows for PROF, HOLD, and SKIP with adjustments. Adjustment can be made left or right with either an automatic or joystick operation. Three blowers are depicted with a display of the rpm, cmd %, and delta psi for each blower filter. A display of the vacuum, mph, and psi for the vehicle provides notice of a cut position, heads up position, or heads down position. An odometer tracks rumble travel distance, rumble cut distance, grinding travel distance, and grinding total (cut only) travel distance. The screen display illustrates down and trim pressures with onscreen adjustment. Indication of tanks levels for water, rumbler, grinders, cyclone, and tank are provided.

Figure 4:
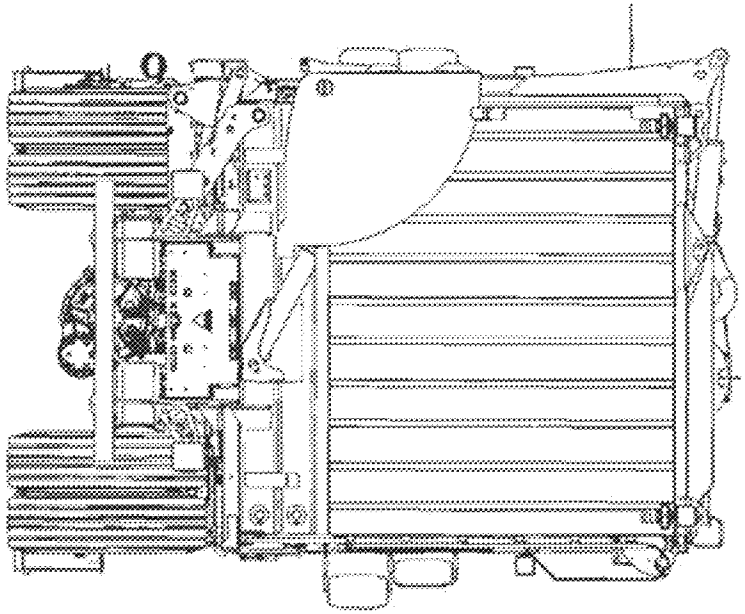
FIG. 4 is a rear view thereof.

FIG. 4 is a subset screen display for up to four heads, allowing focused control, conversation between metric and American standard, and further allowing each head to be bumped up or down with a display of the exact position of the head. Head position in a float/down pressure setting is monitored.

Figure 5:
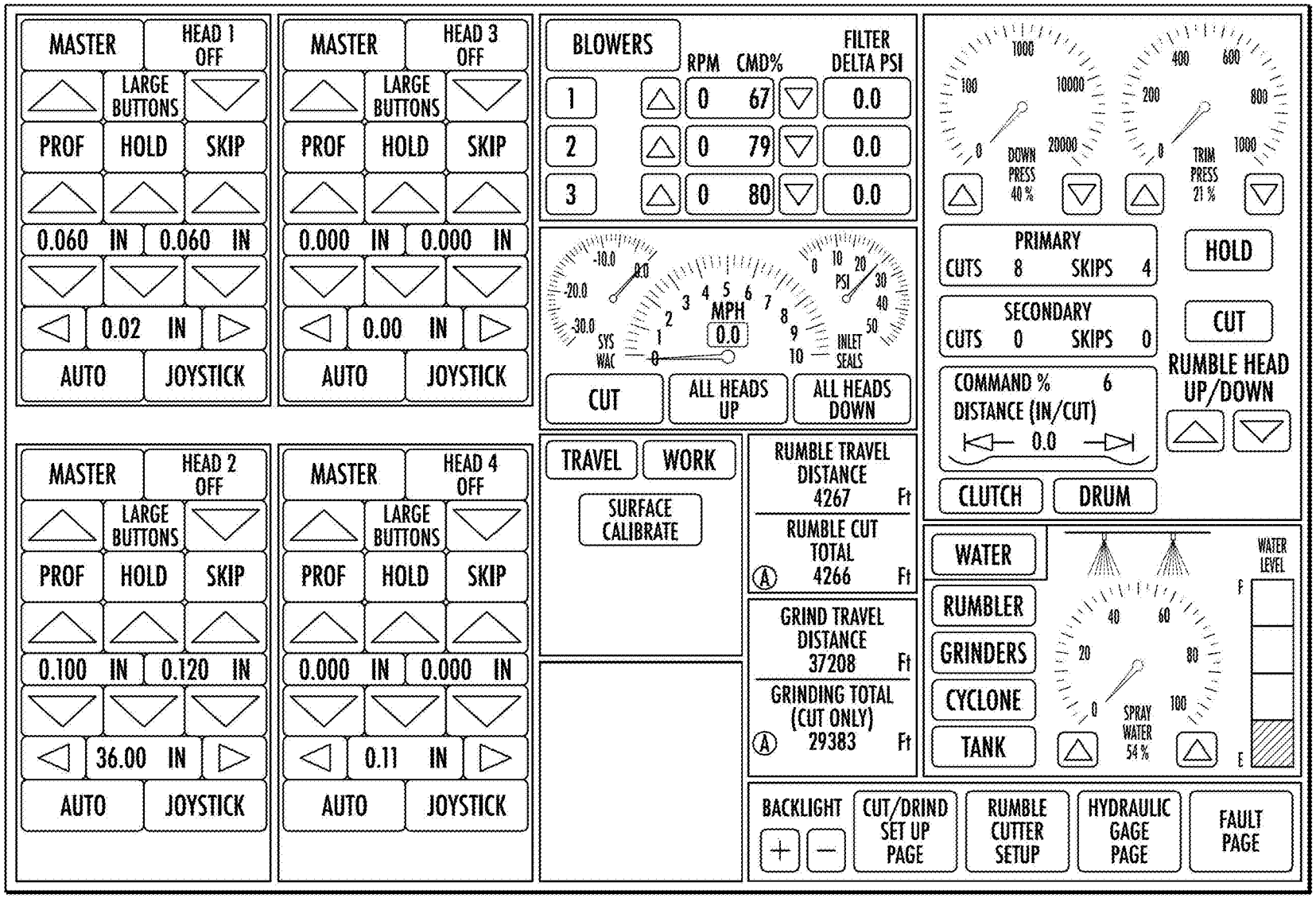
FIG. 5 is a screen display for the computer controlled profiler, illustrating the position of up to four grinder heads, the operation of the blowers, and control of PROF, HOLD, and SKIP adjustments.

FIG. 5 is a screen display that depicts the horizontal slide cylinder MV feedback and cylinder stroke in inches with a pictorial position. Similarly, the left gage cylinder and the right gage cylinder are depicted with MV feedback and cylinder stroke. Calibration of each cylinder can be set from this screen.

Figure 6:
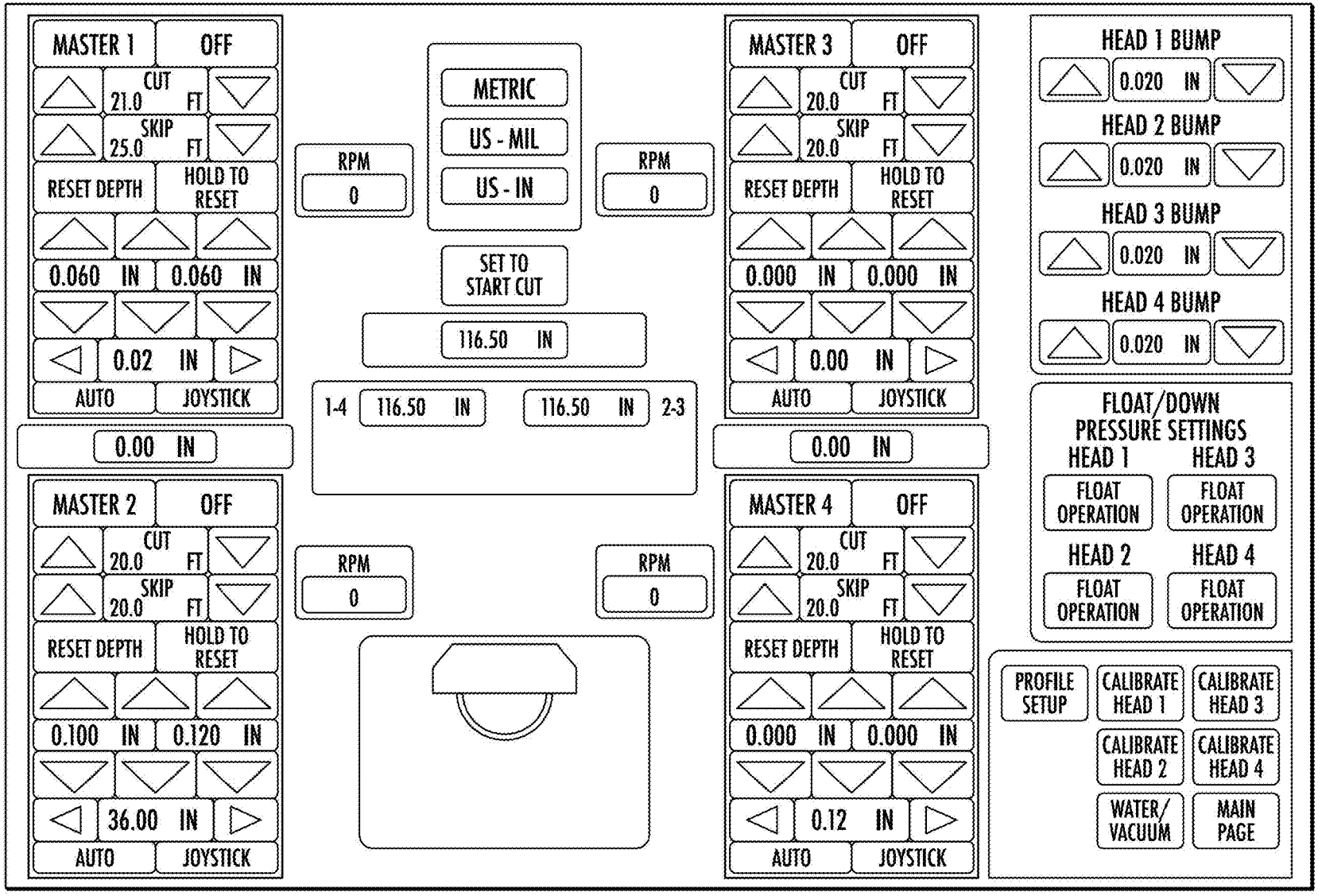
FIG. 6 is a screen display for up to four heads, allowing focused control and each head to be bumped up or down with a display of the exact position of the head.

FIG. 6 is a screen display that depicts up to four grinder profiles and distance between banana cuts. The profile start lead-in distance can be adjusted longer or shorter, and the profile speed can be set from this screen. A reflector cut provides both a depth control and illustration of the reflector cut in relation to the pavement surface.

Figure 7:
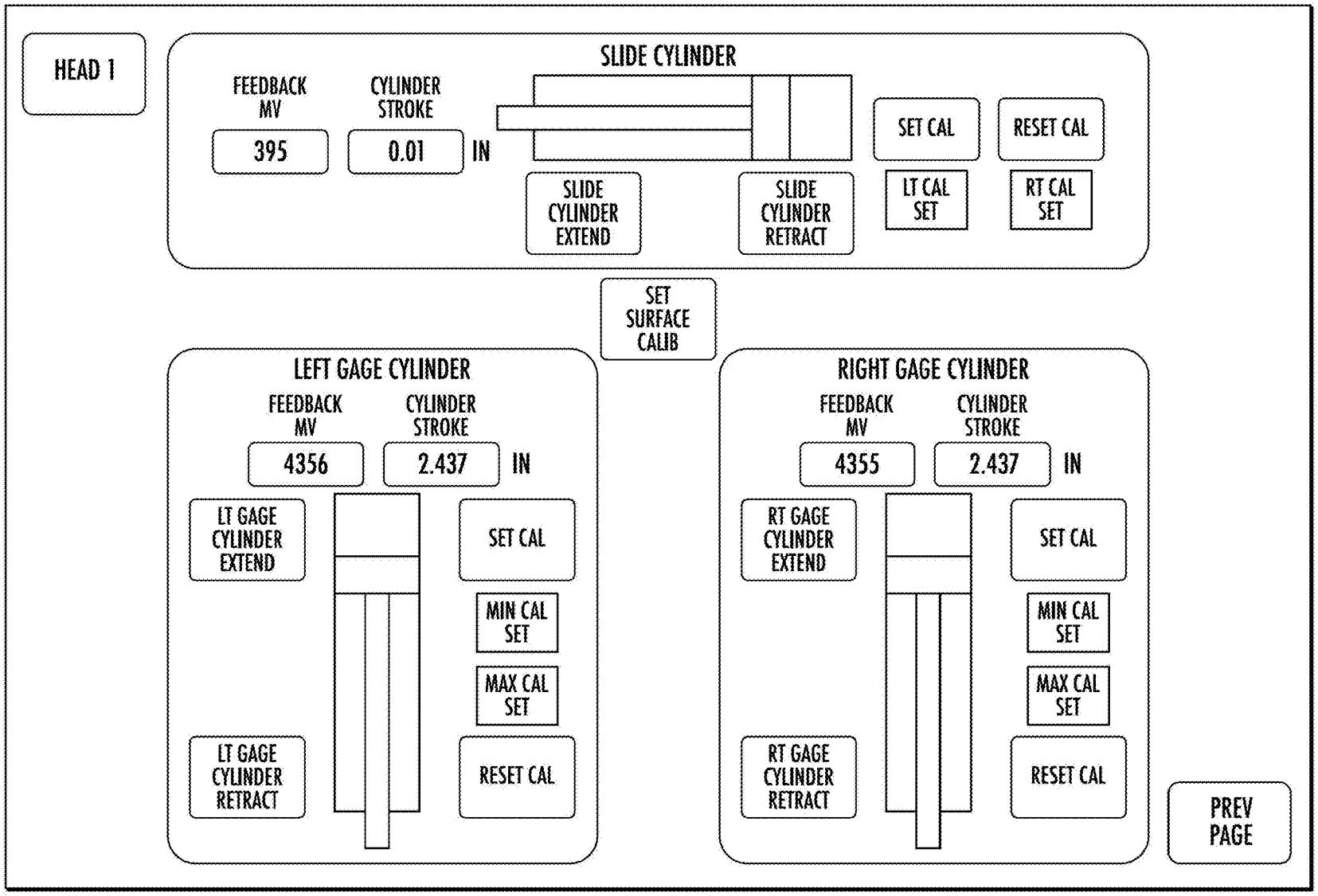
FIG. 7 is a screen display that depicts the horizontal, left, and right slide cylinder MV feedback and cylinder stroke with a pictorial position.

FIG. 7 is a screen display that depicts blower operation similar to the first screen, but with a reverse control. The on/off operation of the vacuum air valves and water valves can be controlled for cyclones, grinders, the rumbler and the tank. Water tank status is provided, as well as head vacuum pulsation and grease pump override. Seal pressure deflate operation can be controlled from this screen.

Figure 8:
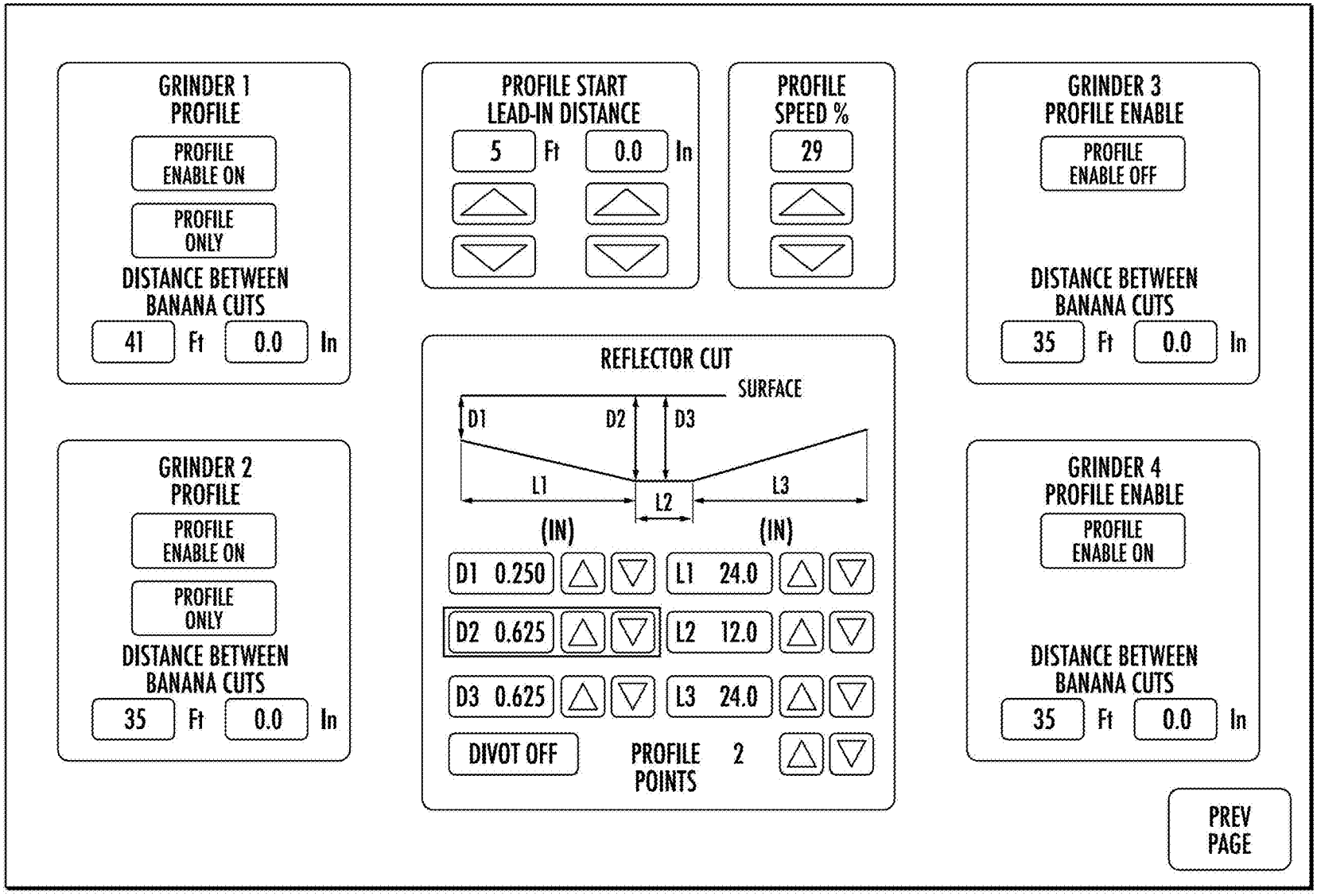
FIG. 8 is a screen display that depicts up to four grinder profiles and distance between banana cuts.

FIG. 8 is a screen display that provides totals for the rumble cut, reflector cut, sine wave cut and grind cut. Control of the depth of each cut is calibrated, controlled and measured.

Figure 9:
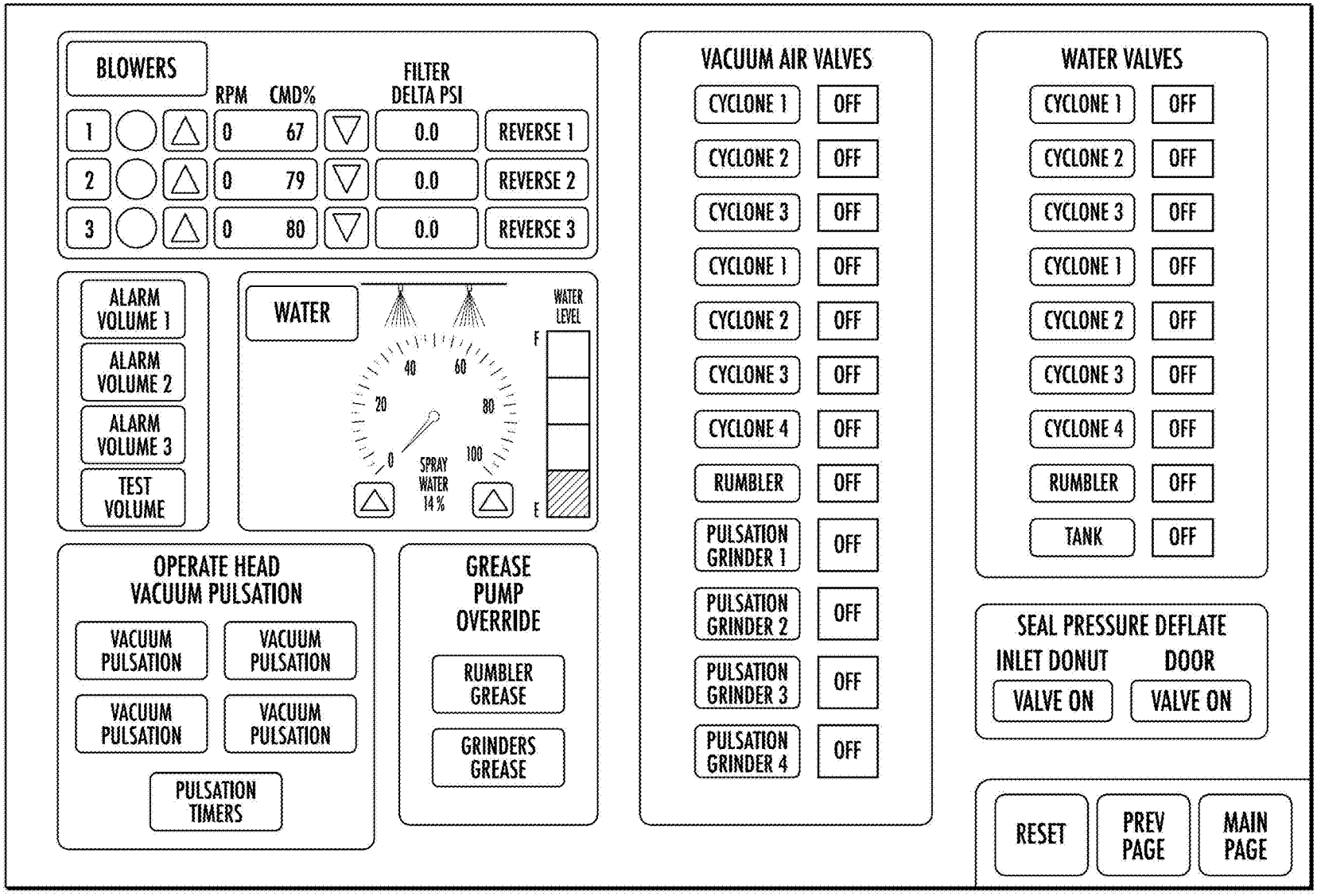
FIG. 9 is a screen display that depicts blower operation with a reverse control, and on/off operation of the vacuum air valves and water valves for control of cyclones, grinders, rumblers and tanks.

FIG. 9 is a screen display that illustrates the rumble cutter side shift, both to calibrate and for shifting of the rumble cutter either left or right. A left rumble head skip cylinder can be calibrated and further extended or retracted, illustrating MV feedback and a measure of the cylinder stroke. A right rumble head skip cylinder can be calibrated and further extended or retracted, illustrating MV feedback and a measure of the cylinder stroke.

Figure 10:
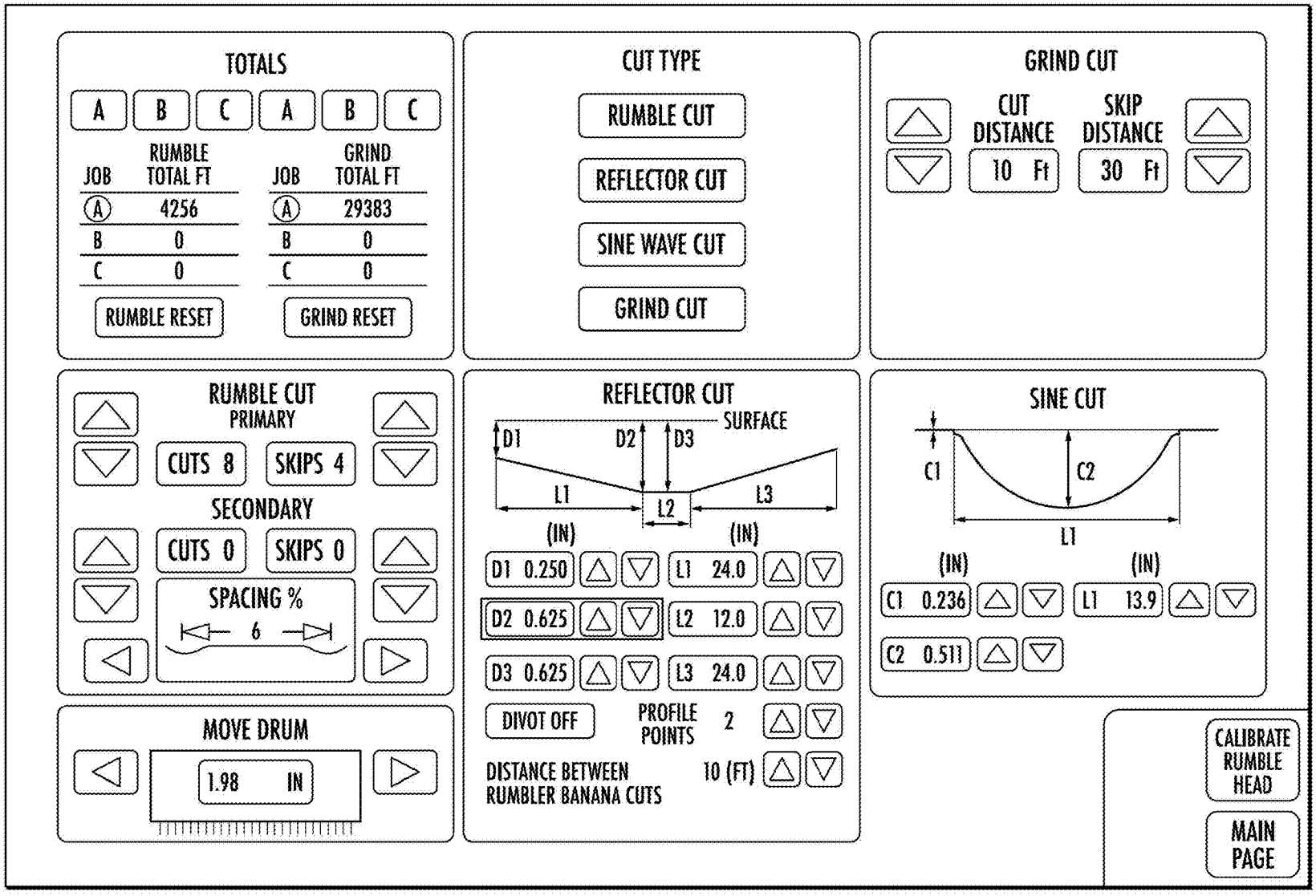
FIG. 10 is a screen display that provides totals for the rumble cut, reflector cut, sine wave cut, and grind cut.

FIG. 10 is a screen display depicting gauges for monitoring Charge and Loop for Blower 1, Blower 2, Blower 3, Propel, and rumbler drum; as well as monitoring of Charge and Loop for Grinder 1, Grinder 2, Grinder 3, and Grinder 4. Miscellaneous gauges present inlet seal, down pressure, eccentric, water psi, trim pressure, aux pump, and vacuum.

Figure 11:
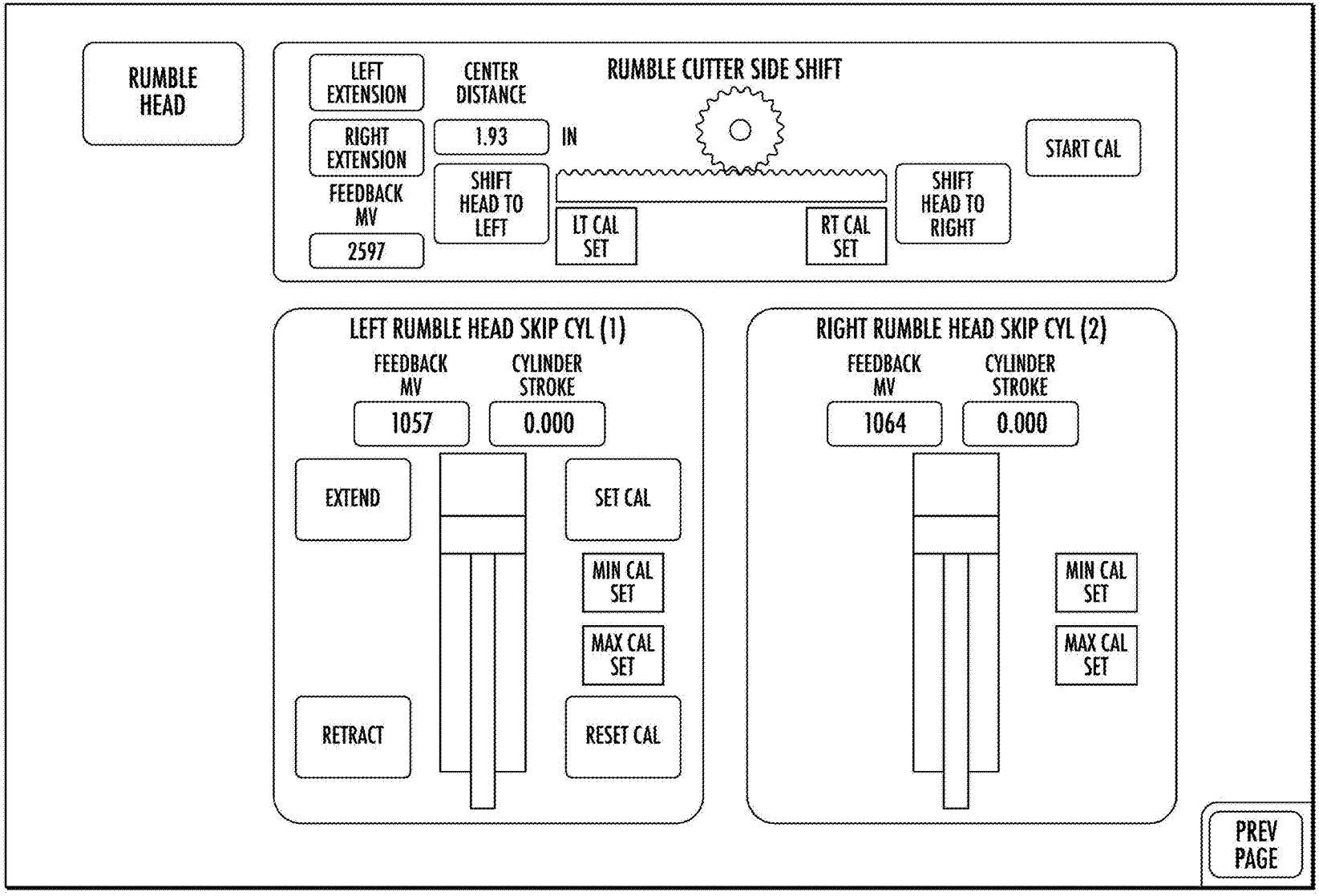
FIG. 11 is a screen display that illustrates the rumble cutter side shift, both to calibrate and for shifting of the rumble cutter either left or right.

FIG. 11 provides a screen display providing a visual depiction of eight controllers and a bus map.

Figure 12:
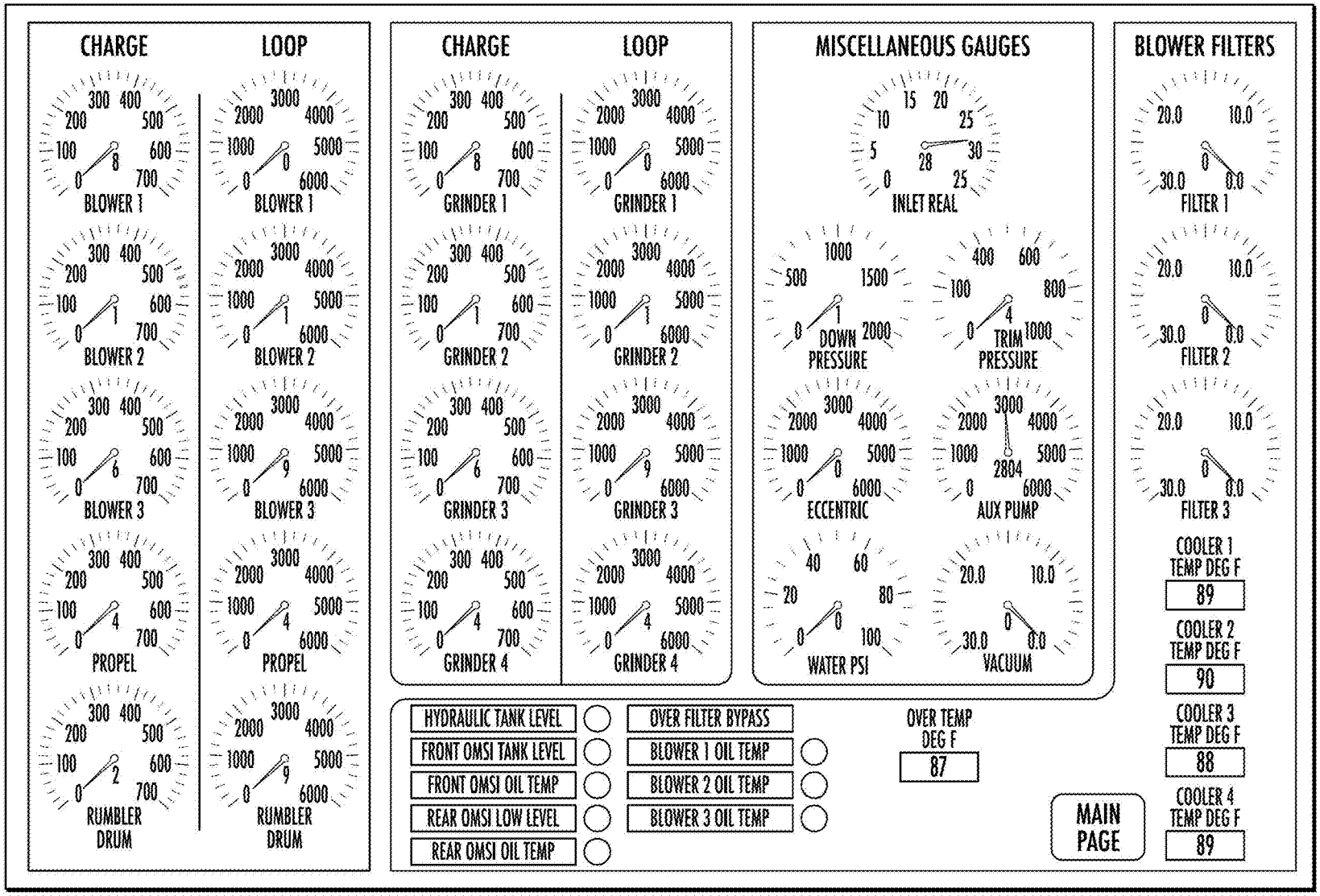
FIG. 12 is a screen display depicting gauges for monitoring Charge and Loop for blowers 1-3, grinders 1-4, Propel, and rumbler drum.

FIG. 12 provides a screen display for Controller 1, depicting faults and calibration statements for the joystick, skip cylinder 1 and 2, skip retract valve, skip extend valve, propel forward and reverse output, auxiliary pressure, propel loop pressure, propel charge pressure, hold down pressure, water pressure, cut loop pressure, cut change pressure, distance encoders, cutter forward, cutter reverse, and orbiter displacement.

Figure 13:
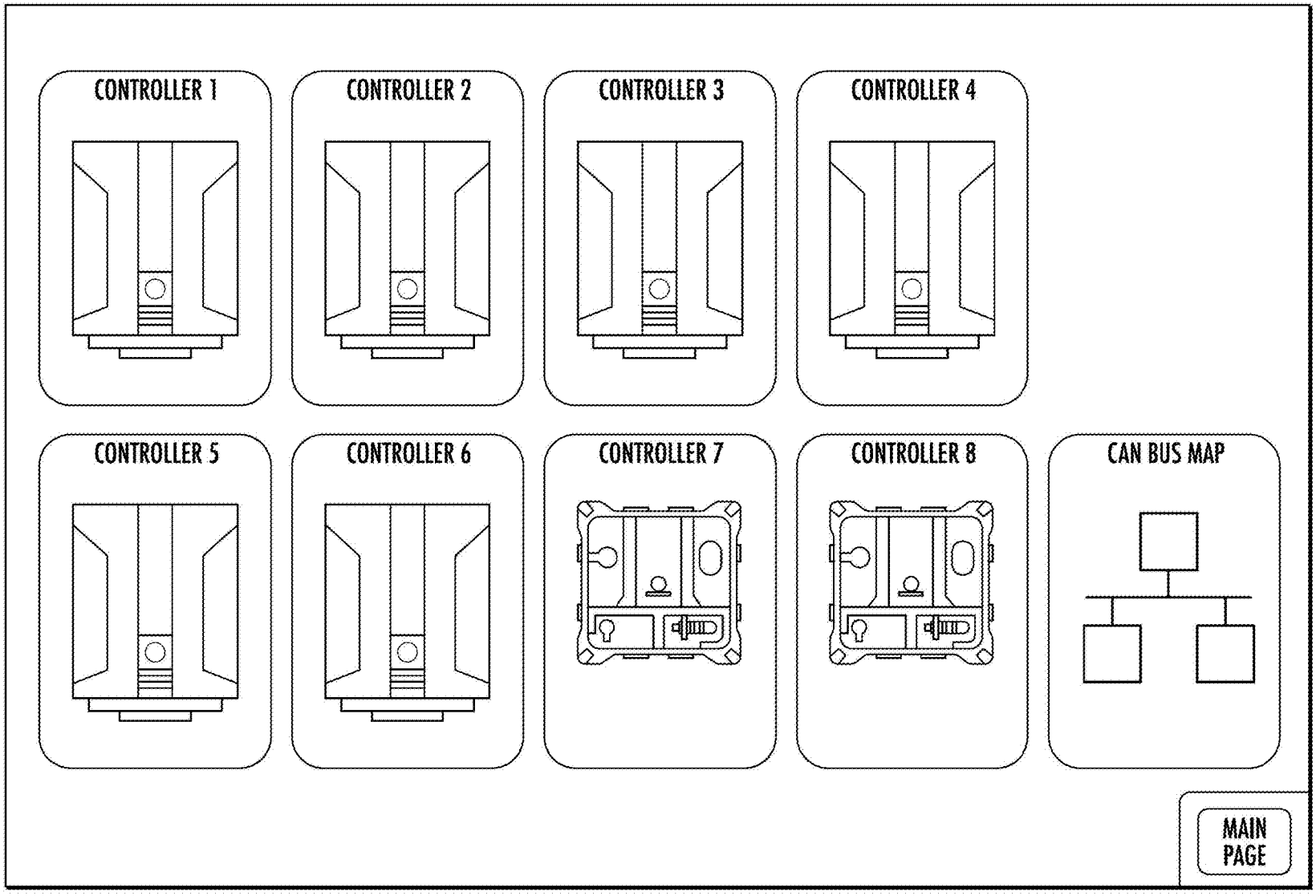
FIG. 13 provides a screen display with a visual depiction of eight controllers and a bus map.

FIG. 13 provides a screen display for Controller 2, depicting faults and conditions of OX 24, left and right keypads, sensor power, PTO engage, OMSI over temp, rumbler slide encoder, Grinders 1-4 air valves, clean water level sensor, door seal pressure sensor, OMSI 1-2 engage and disengage, door selector valve, inlet donut seal deflate valve, tank up-down valve, Grinders 1-4 vacuum pulsation valves.

Figure 14:
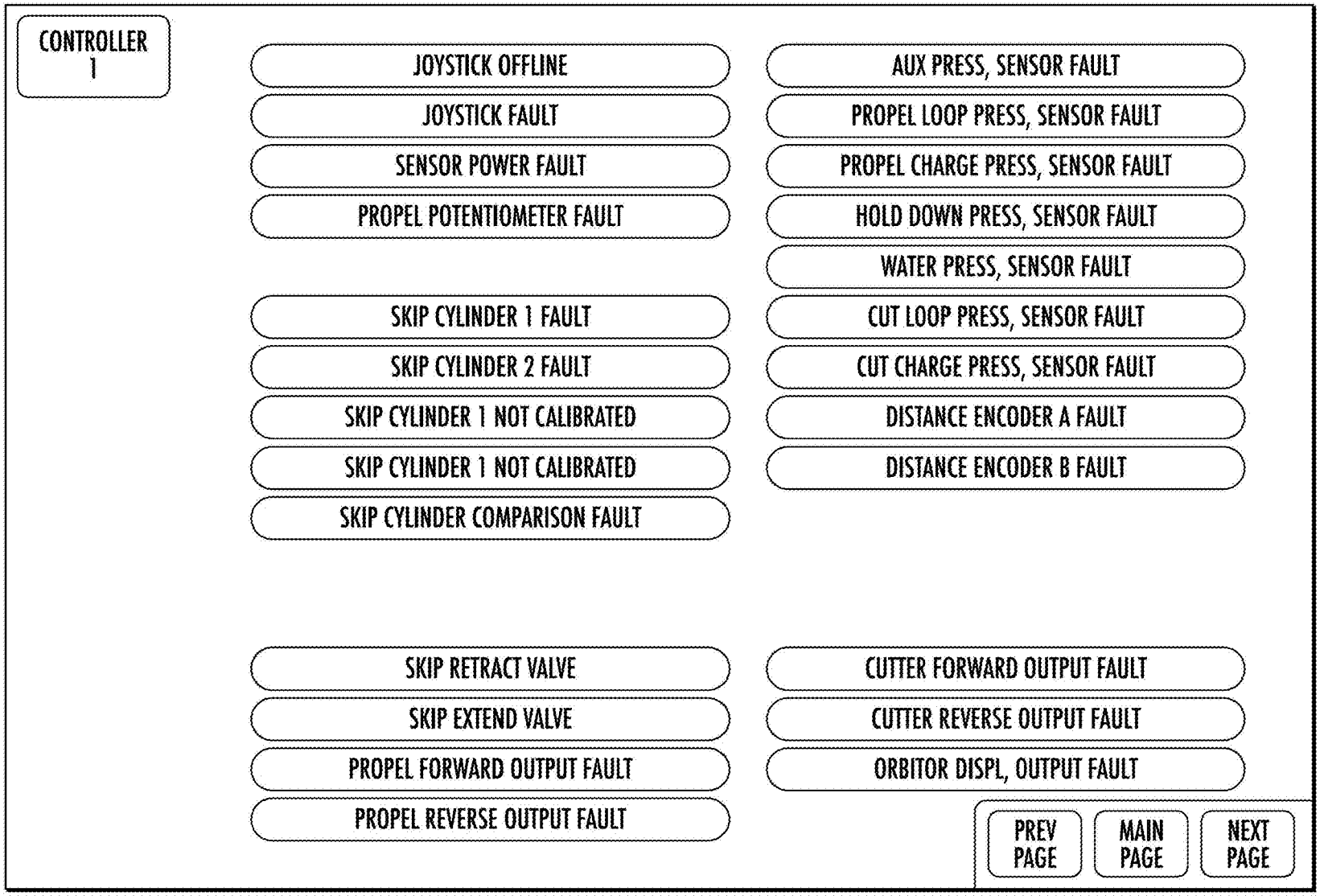
FIG. 14 provides a screen display for controller 1.

FIG. 14 provides a screen display for Controller 3, depicting Grinders 1-2 slide cylinder fault and calibration, Grinders 1-2 left and right cylinder fault and calibration, sensor power fault, OX module, blower forward, blower reverse, trim reduced pressure valve fault, trim pressure sensor, tank water valve, door seal deflate valve, and down reduced pressure valve fault.

Figure 15:
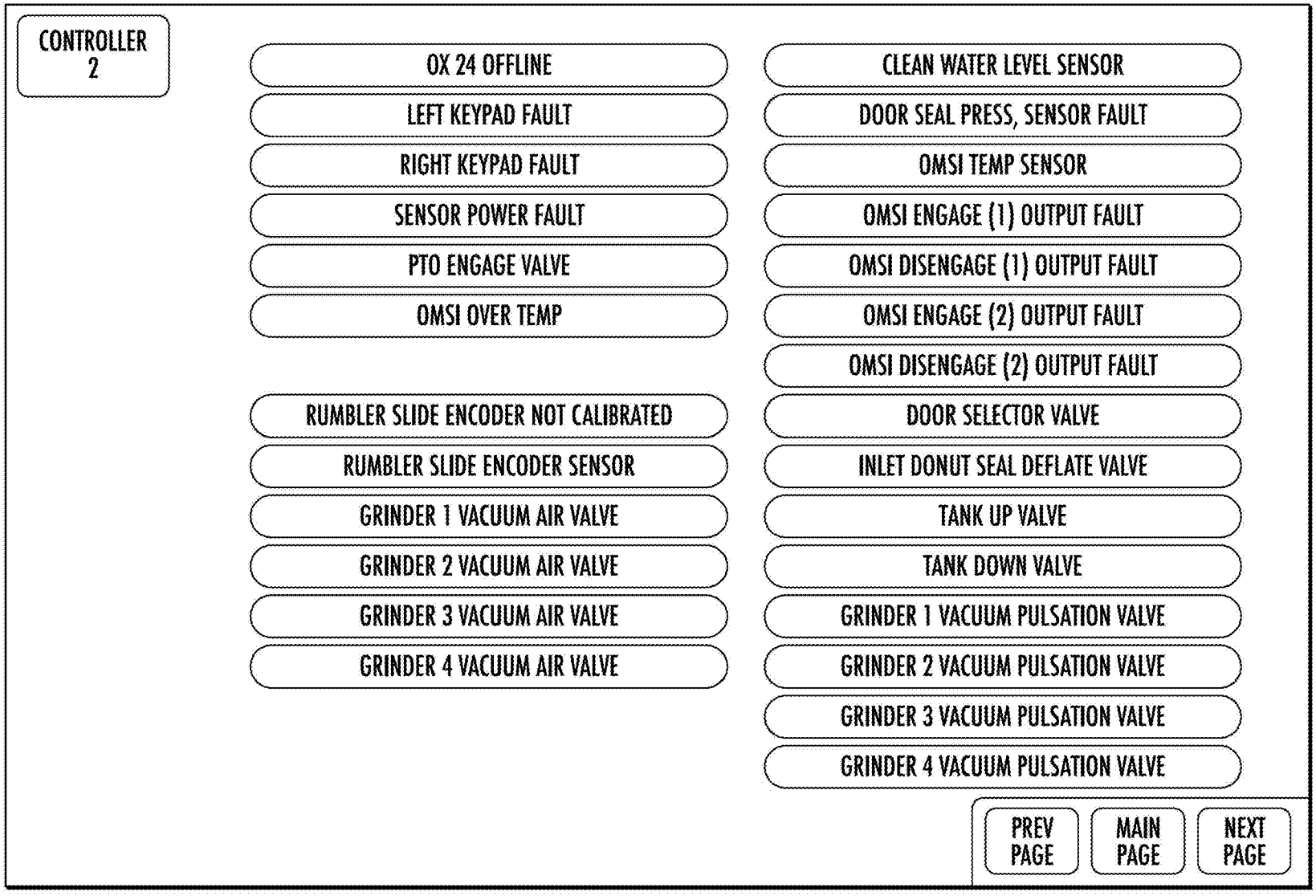
FIG. 15 provides a screen display for controller 2.

FIG. 15 provides a screen display for Controller 4, depicting sensor power, Grinders 3-4 slide cylinder fault and calibration, and Grinders 3-4 left and right cylinder fault and calibration.

Figure 16:
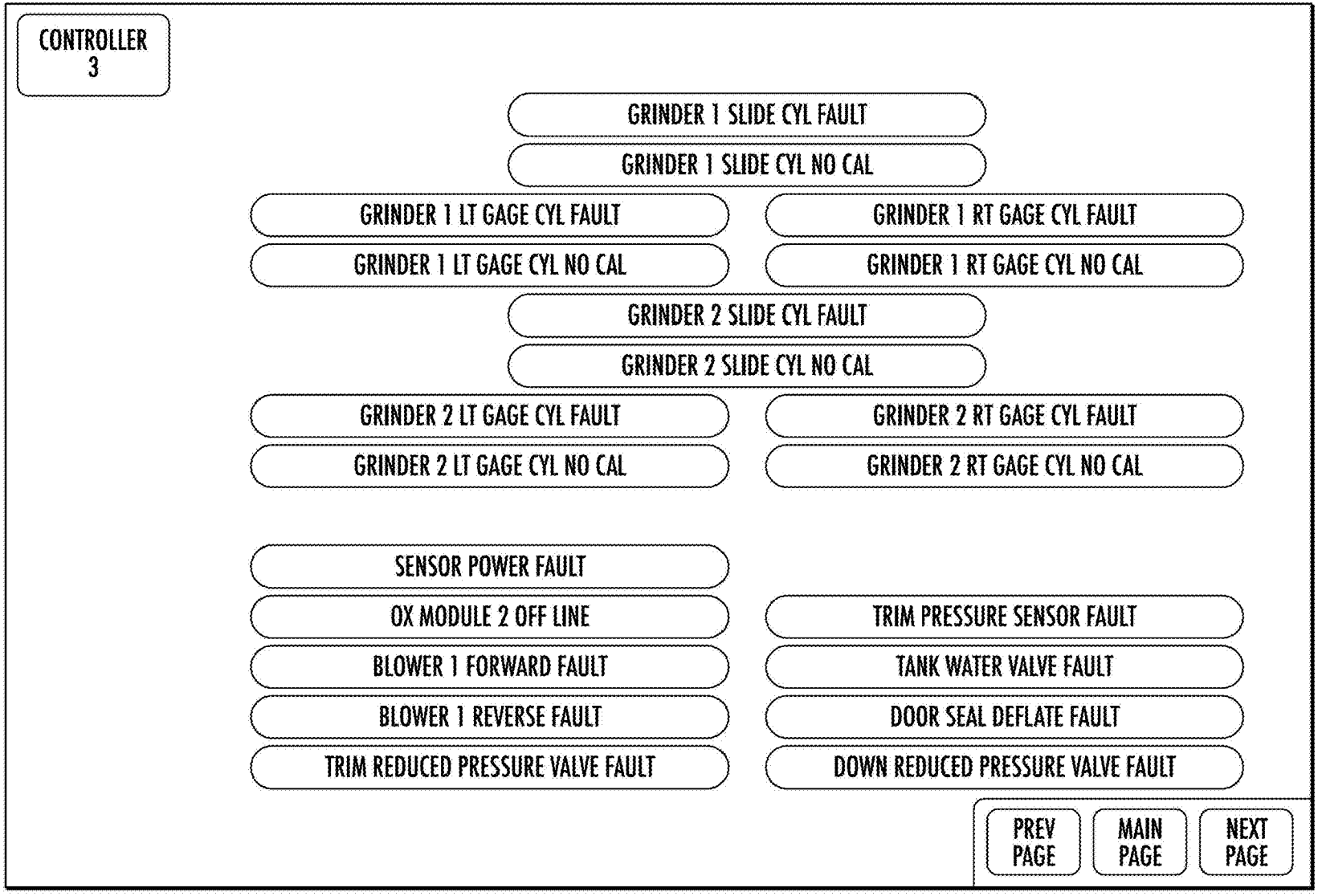
FIG. 16 provides a screen display for controller 3.

FIG. 16 provides a screen display for Controller 5, depicting blower loop 1-2 pressure fault, Grinder 1-4 loop pressure fault, sensor power fault, Blower 1-2 charge pressure fault, Grinder 1-4 charge pressure fault, system vacuum sensor, Blower 2 forward output fault, Blower 2 reverse output fault, Grinder 1-4 forward output fault, and Grinder 1-4 reverse output fault.

Figure 17:
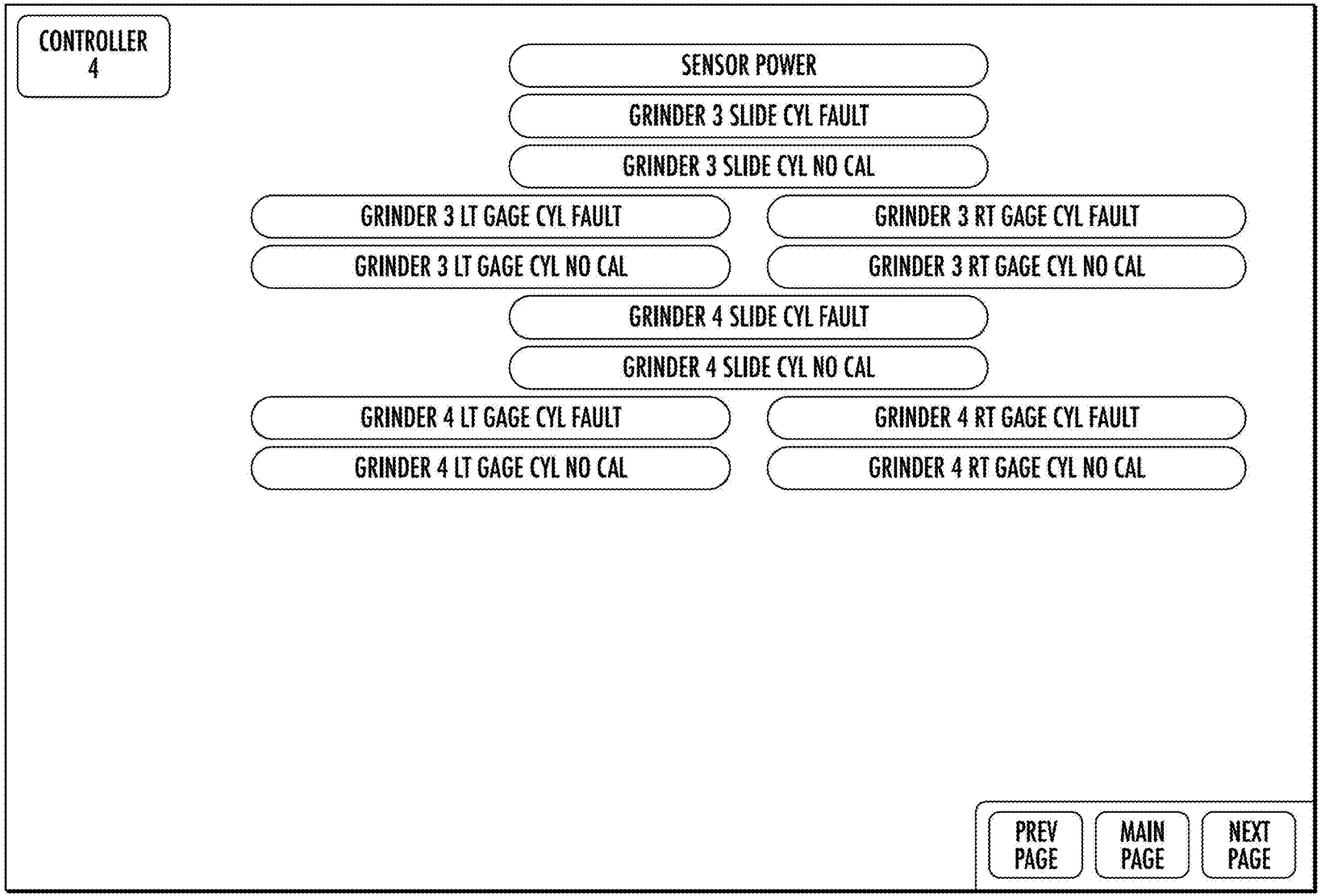
FIG. 17 provides a screen display for controller 4.

FIG. 17 provides a screen display for Controller 6, depicting blower loop 3 pressure fault and loop 3 charge fault, grease pump 1-2 input fault, rumbler vacuum air valve fault, Grinder 1-4 water valve fault, rambler water valve fault, eccentric pressure sensor fault, Blower 1-3 filter sensor fault, radio communication fault, latch selector valve output fault, chute selector valve output fault, tilt sector valve output fault, cyclone valves 1-3 output fault, Blower 3 forward output fault, Blower 3 reverse output fault.

Figure 18:
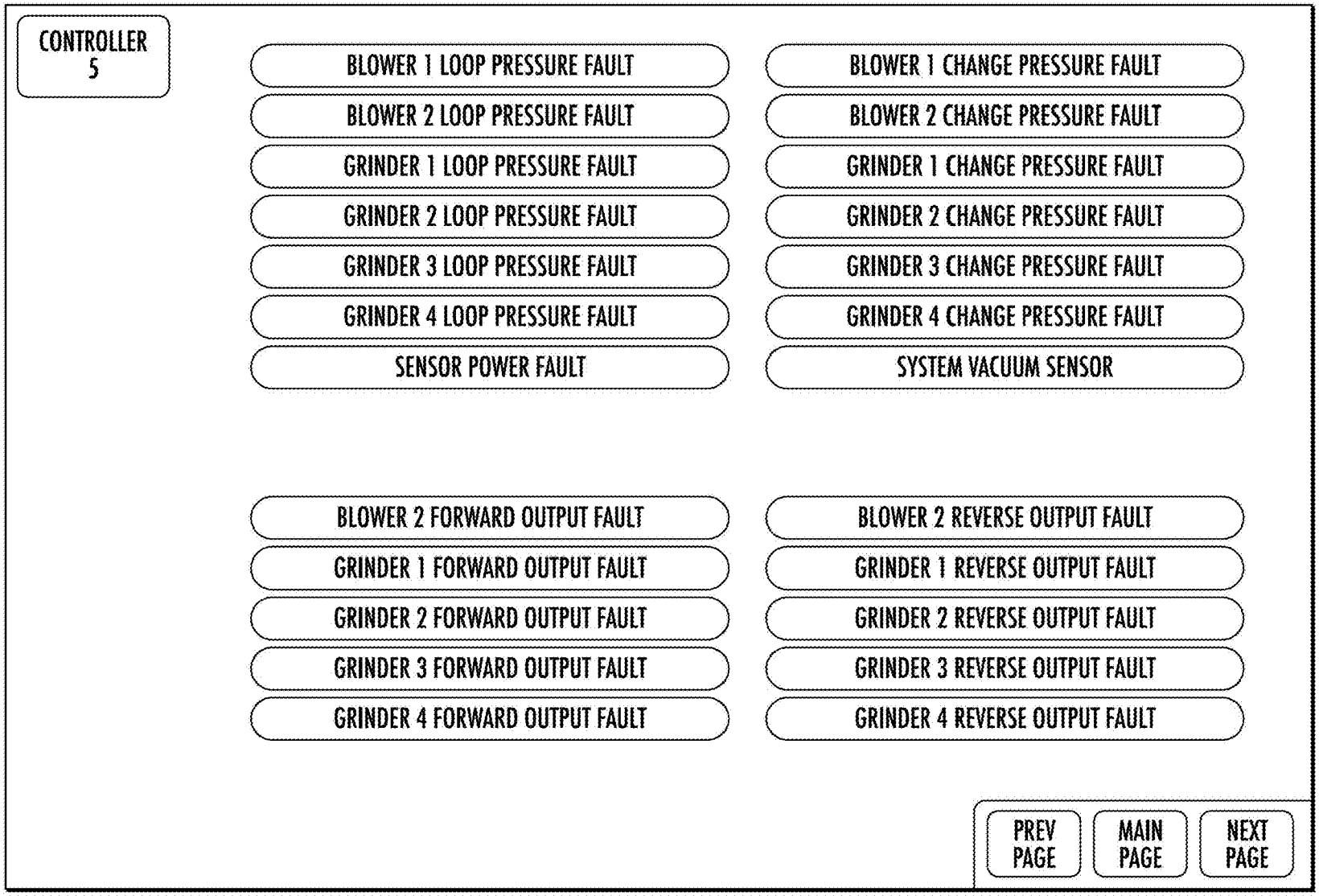
FIG. 18 provides a screen display for controller 5.

FIG. 18 provides a screen display for Controller 7, depicting cooler 1-2 temperature sensor faults, and cooler fans 1-2 faults.

Figure 19:
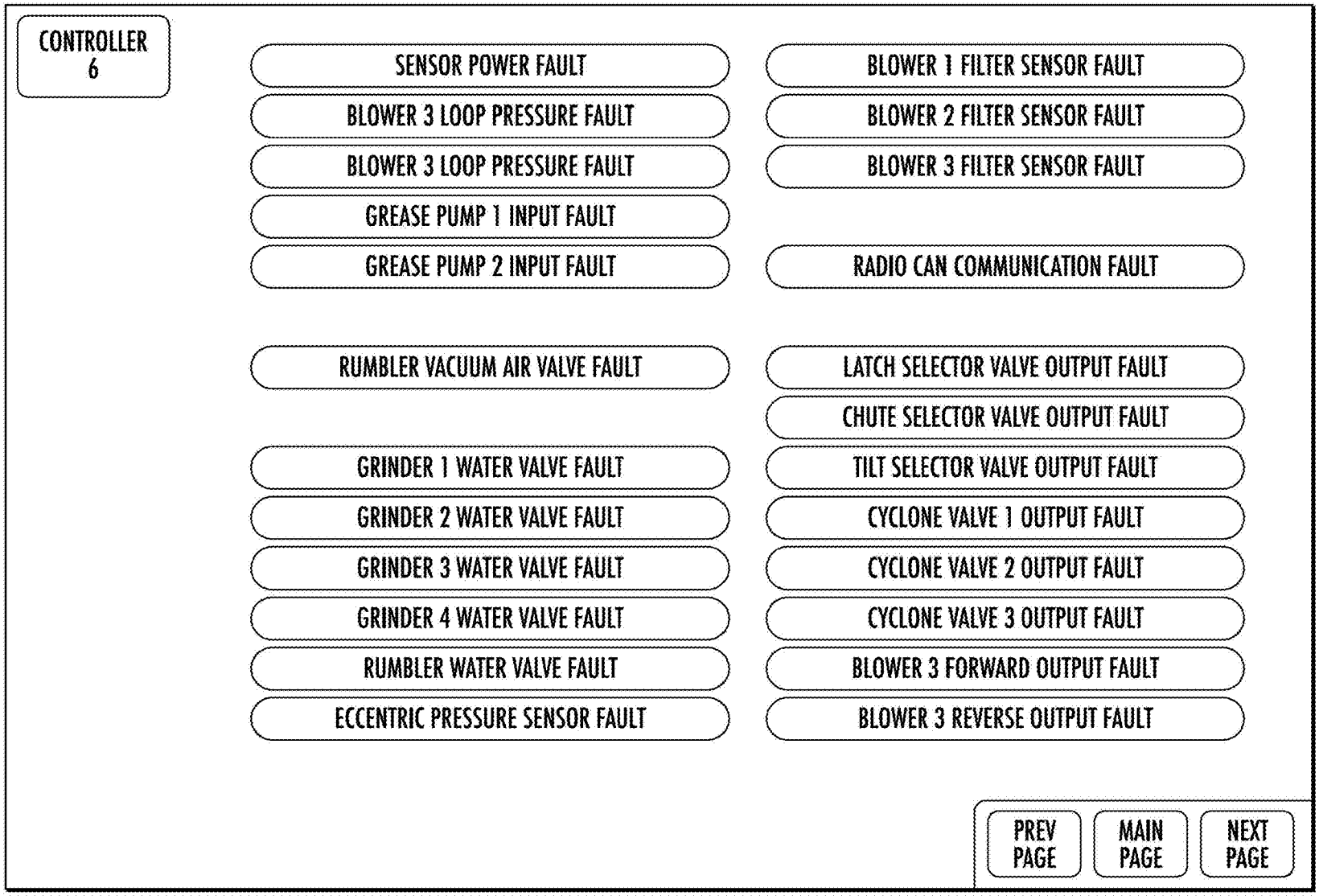
FIG. 19 provides a screen display for controller 6.
Figure 20:
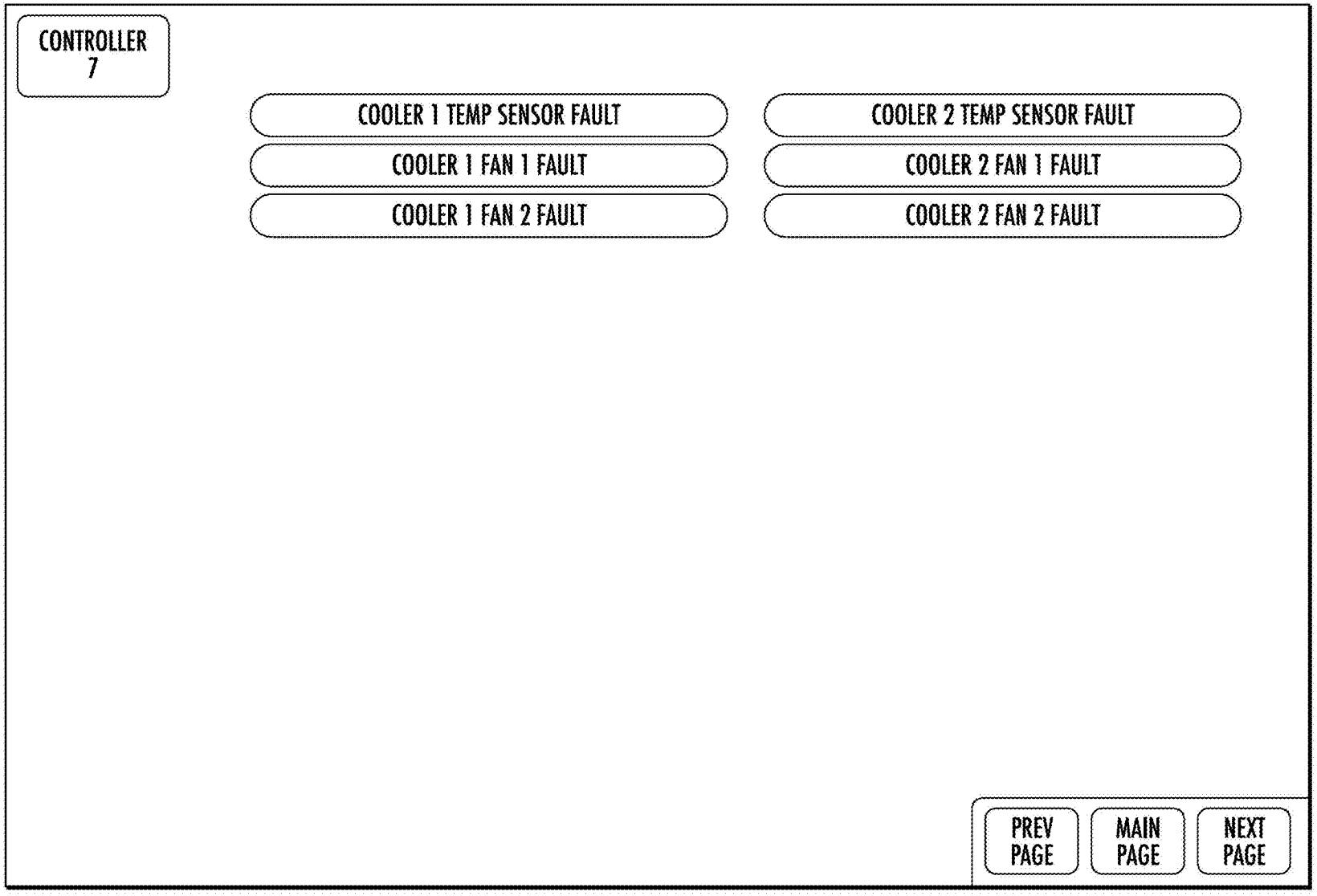
FIG. 20 provides a screen display for controller 7.
Figure 21:
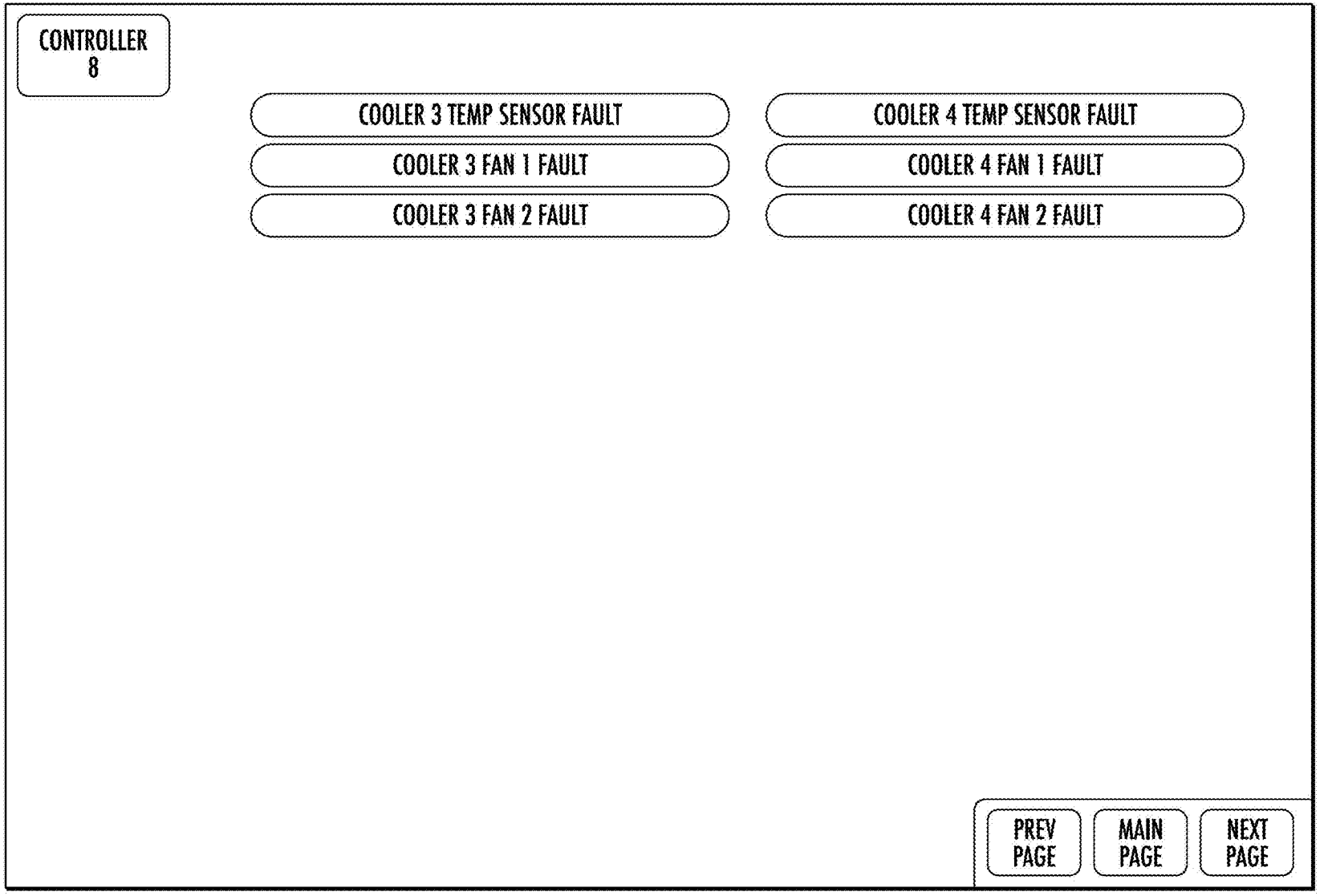
FIG. 21 provides a screen display for controller 8.
Figure 22:
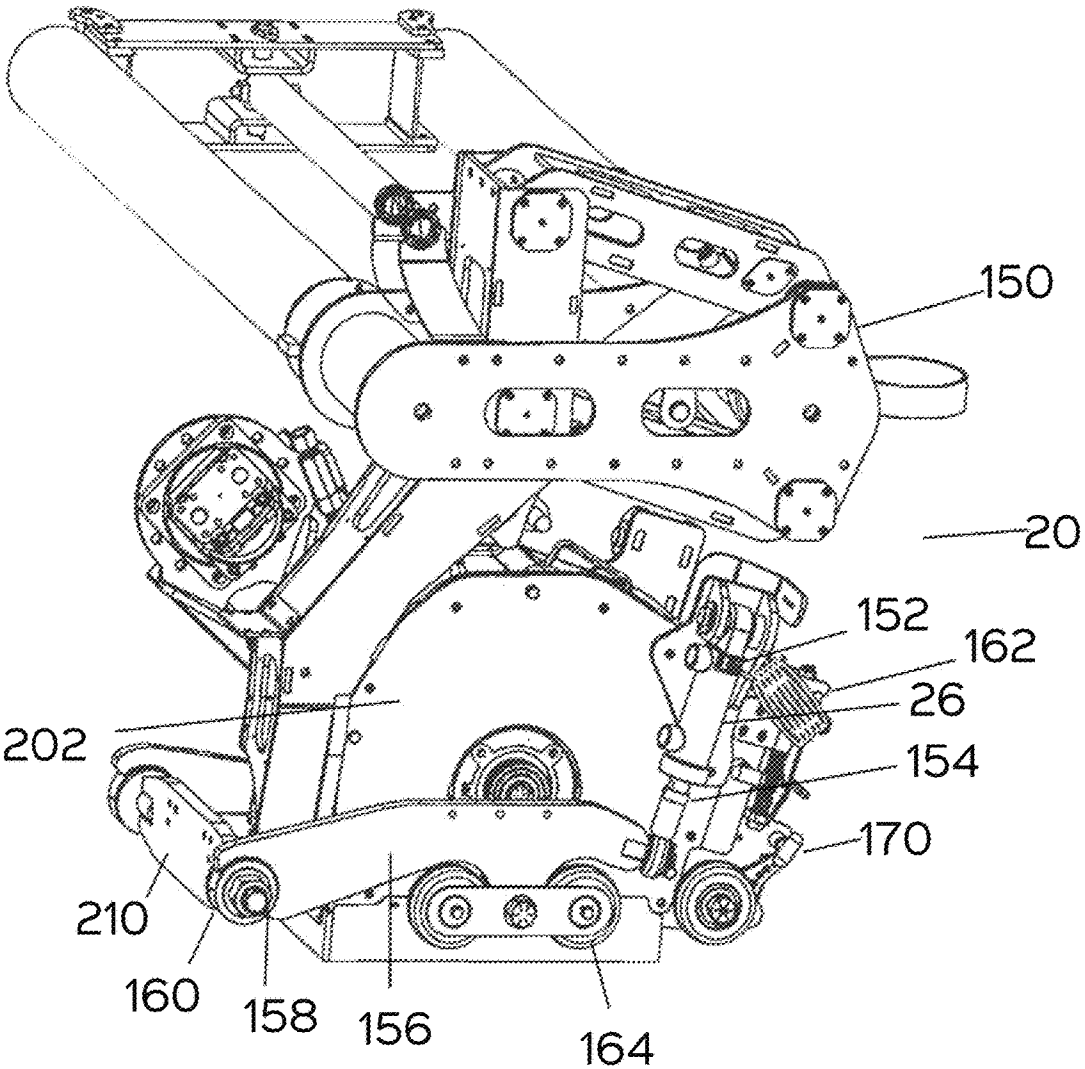
FIG. 22 is a left side view of the grinder head of the instant invention.
Figure 23:
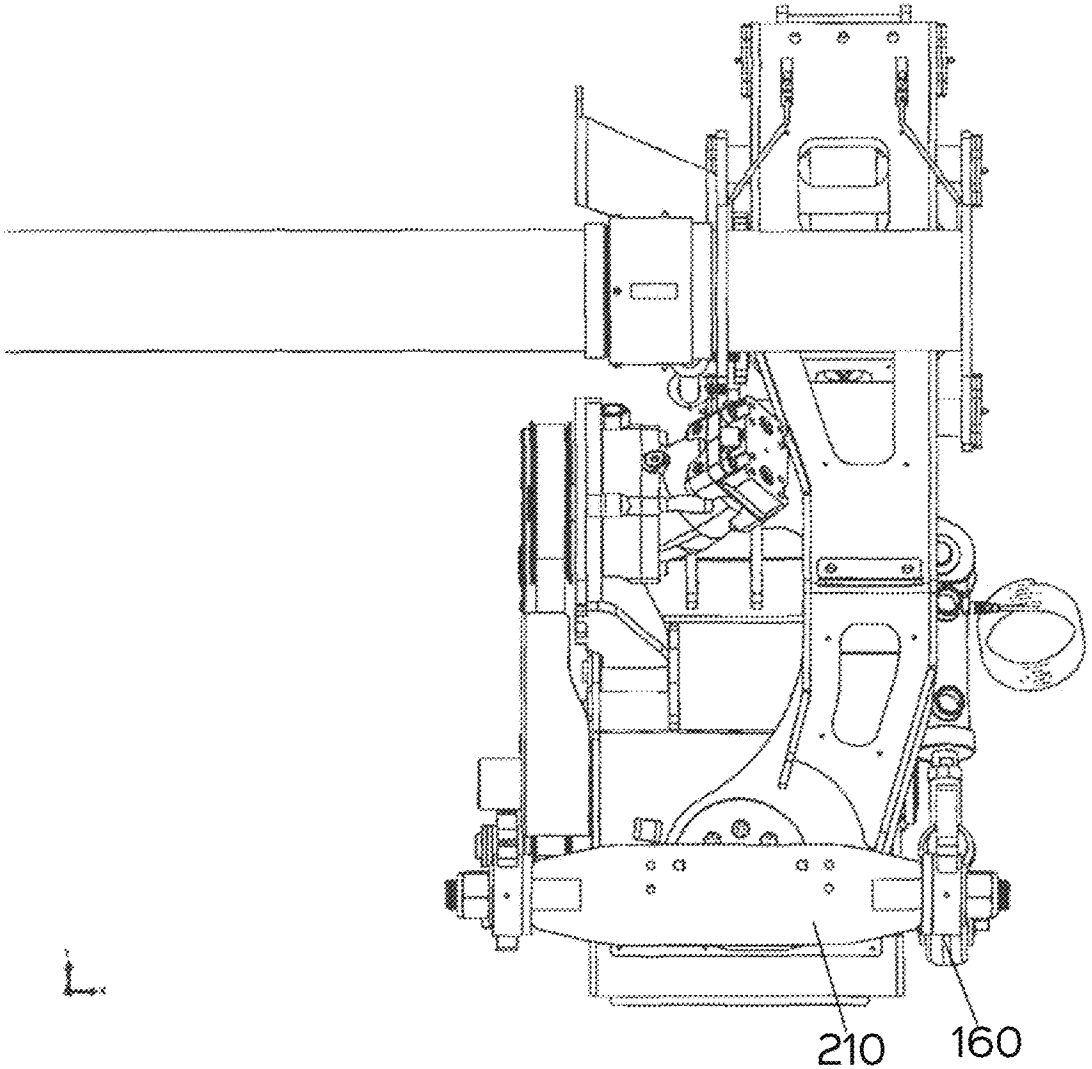
FIG. 23 is a front side view thereof.
Figure 24:
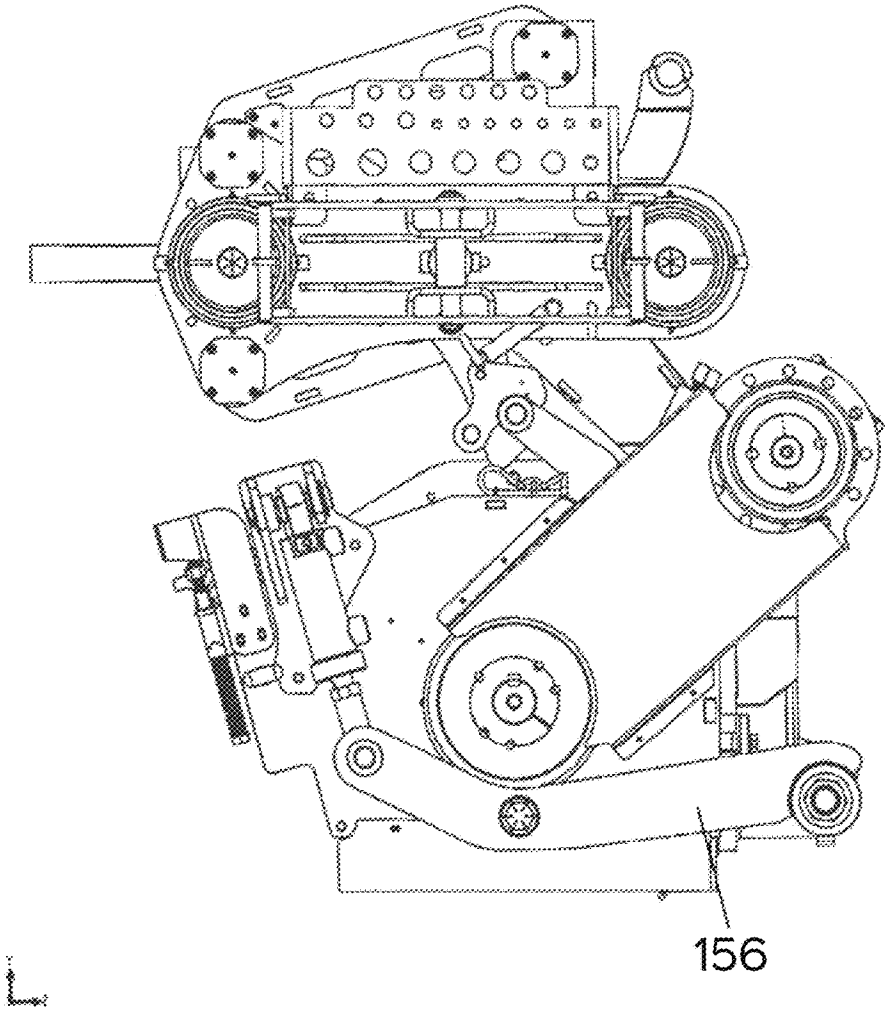
FIG. 24 is a right side view thereof.
Figure 25:
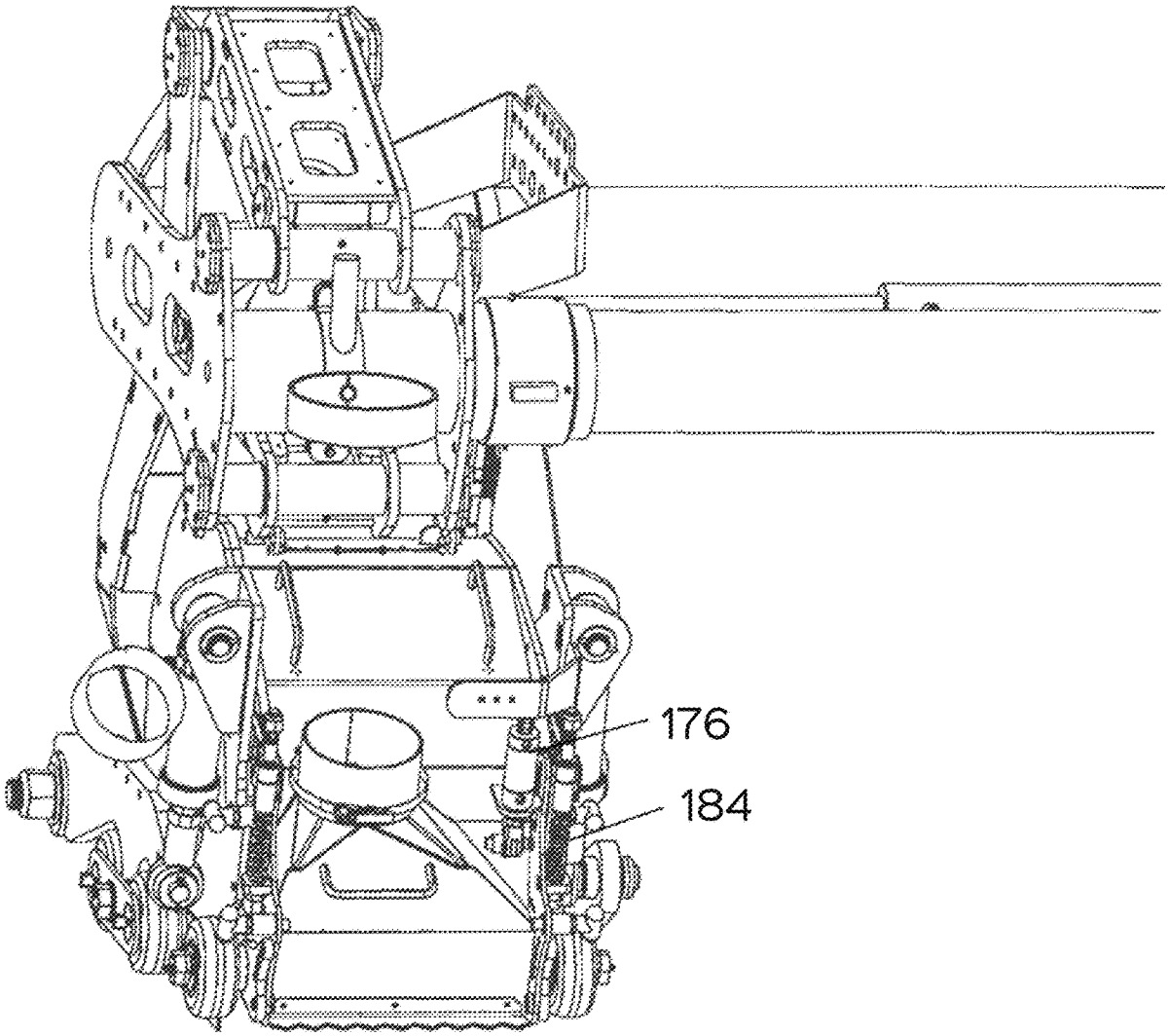
FIG. 25 is a rear view thereof.

FIG. 19 provides a screen display for Controller 8, depicting cooler 3 temperature sensor fault, and cooler fan 3 fault.

By way of example, in a snow marker example, instead of a stop and go scenario, the device can cut a rumble strip whereby a cutter head begins by sinking into the asphalt by maybe ⅛" while the vehicle travels at a given speed forward and the cutter head dips in and out. The rumble strip can be precisely cut to create particular sounds. For instance, one sound is where the rumble strip is designed to reduce noise pollution outside the vehicle for nearby houses and persons that might be in the area. In another example, the rumble strip patterns will require the cutter head to come completely up out of the road surface, and skip a distance two or three feet to allow room to create an area for bicyclists to cross in and out of the rumble strip without producing any violent action to the bicycle wheel.

The computer controlled grinder head may operate in conjunction with other grinder heads. For instance, two grinder heads may be used for cutting banana cuts for use in recessed markers, or in between a skip pattern. Cuts can be made on both sides of the truck; the banana cut having a reflective marker inset into the roadway and at the end of a cut extend from zero down to about ¾" below the road surface, and then comes up very abruptly over the space of about two inches and repeats about every 40 feet. An inclination can be set at zero and is adjustable to any angle. Any profile, cut, or any custom cut profile elected is stored, eliminating the need to stop the vehicle for adjustment or grinder change-out. With all cuts matched, the operator does not have to stop the vehicle, and all cuts will be in a line. For instance, if an interstate has six lanes, all lanes may start at the right point and match. To cut two skip lines on an eight lane highway, Grinder A would be on the left side of the truck and Grinder B on the right side of the truck. With one skip line on one side and one skip line on the other side, an offset can be created. In this example, the master head would be on the left side of the truck and the operator is following a pattern with the cross-hair generator. Another skip line could be placed on the right side of the truck and, instead of both cutter heads cutting at the same time, if it was a 10-foot skip line followed by a 30-foot blank space, the operator could cut left side 10-foot patterns while the right side is resting. Traveling another 20 feet, then the right side would be cutting and the left side resting to create an offset pattern.

In another example, the computer controller of the instant invention provides preprogrammed controls, such as when the truck and grinder head approach a bridge deck where the truck will be leaving asphalt roadway and entering concrete bridge surface; at which point the grinder head needs to be lifted. In a conventional machine, the operator is required to press four separate buttons, all at the right time, to make all the lines stop at a desired position, requiring a highly trained operator for proper control. On the instant invention, a single button is depressed, which would lift the master upwards so the moment that the next head in line would come to that precise point of that bridge set, it would also lift. Similarly, the heads on the opposite side of the truck would lift. When the truck crosses the bridge, the master head is lowered into position, and all the heads that are active in the process would be lowered at the exact point to allow for even line positioning.

In another example, a master/slave grinder, Head A, forms a lead head on the driver's side. The vehicle can have up to two heads on either side, but it could have any number, it could have three, it could have four. In this example, Head B is behind Head A. Head C and Head D would be placed on the passenger side. Head A can be offset from Head B. A typical configuration would be a double yellow on the driver's side of the truck, and a single white edge line on the passenger side. If removing a strip on a two-lane, curvy country road, the head on each side of the truck will track the lines. In this example, a further requirement is for cutting grooves in the road to receive markings; the grooves providing protection to the markings from wintertime snowplowing. In this example, the markings are already in place, and the requirement is to match the existing markings. For instance, the operator moves the vehicle and notes that he is missing the mark slightly on the double yellow, and he needs to move Head B while Head A is the master. Head B needs to move over to the left by ⅛$^{th}$ of an inch. A preset movement is provided by each jog of button, with the desired movement per push to a desired set point. Each time a left or right-hand button is depressed, Head B can move a pre-determined ⅛", or whatever you set it to. If the operator moves Head B over ⅛", Head C on the passenger's side will not change because of the relation set between Head A and Head C.

A calibration page, or grinder set up page, depicts four blocks on a display screen that represent the grinders and displays changeable functions. The display screen allows the operator to change a relationship between any one head, or another, independently. Thus, there can be two masters. One master may be controlling only one head, and it may be the forward head on the right side controlling the rear head on the right side. Another master may be on the left side of the truck, allowing different combinations. In this manner, the heads can be programmed to follow each other, be offset, or any other combination, while the vehicle is stopped or moving. For instance, if a master is linked to a left side grinder, but the operator is working on the right side of the truck, to address a transverse marking, the operator can hit a button release, grab it with the joystick and move it over and start that transverse on that groove, as it is easy to pick it up later and reset. Another example is if there is a double yellow center line on a left side of the vehicle, a white edge line on the right side of the vehicle, and a turning lane approaching. In one example, the vehicle can stop, discontinue the cutting head, and pick of the position later. In another example, a head can be used to follow a skip line. A 10 foot skip followed by a 30 foot pattern, or a 20 foot skip followed by a 20 foot pattern, can be preprogrammed. Further, the skip and pattern may vary from state to state. The actual pattern is programmable.

In this example, while cutting a solid line, the skip pattern is considered underneath the grinder head; the grinder is not turned on. With the system engaged, preprogrammed patterns can be engaged to meet the pattern. Maintaining a fixed distance is precisely held by use of pre-established, digital spacing. If a double solid line has one line that becomes a skip, the system turns to check alignment and then stays in alignment with both the left and right side of the truck and the skip lines addressed. If the double lines are labeled A & B on the left side of the truck and the white line is labeled C on the right side of the truck, the heads of the same label can address each line and pattern independently at any given time.

The rotary actuator, or encoder, can reassign the head just by hitting the button once. Re-assign it to the position of the master, and the system knows where the skip is. The system controls multiple heads capable of performing multiple patterns on the fly.

A remote controller 90 can be placed anywhere on the grinder truck, or operated separately from the truck by use of a Bluetooth connection. The remote controller allows an operator to select a grinder head and control all aspects of the grinder head. For instance, the remote controller can modify the depth of the grinder. If an operator notes that one of the grinder heads is a little low, the operator can bump up the cutting head. The remote controller has an indicator light for each of the heads, and allows the operator to select a head and then bump the remote control for moving control cylinders in an up, down, left or right position. If the operator is slightly off the line, the operator keeps the cross-hairs depicted on the display on the far left edge line, or joint, or whatever the operator is following, and then the guy following behind can tune the position of the heads very closely with the remote controller.

The system can be set at a zero point, which is the surface of the payment. A cutter head set for the zero point might be used to just remove markings. Over time, the cutter head will have tooth wear and wheel wear. Therefore, zero point, the point at which the cutter actually touches the road, will change based on wear. The system allows adjustment of the zero point. The operator can change the bump value; it can be 1 thousandth of an inch, 50 thousandths of an inch, or so forth. For instance, if the operator has the system set for 20 thousandths and the operator is cutting an 80 mil groove, the operator may understand that with four bumps he will be placing the head where it needs to be. A screen display illustrates where the head is, but the screen is not required or any math; the operator knows the use of the bumps up or down provides instant adjustment. Similarly, a left, middle and right cylinder bump button allow left side or right side adjustment. If the road is pitching to the right, the operator can bump the cylinder to assure proper cutting. If the operator hits the master bump on that head, it bumps both of them so that a slight tilt is maintained.

The remote controller 90 has shift functions, including the ability to move the head in and out. The head can be picked up and stowed. The head can be raised up and down, slid in and out, and each head can be moved left or right, independently. Basically, eight functions of the heads can be controlled from the remote control. The grinder employs T-handles to allow ease of shield removal without tools. Removal of the shield allows inspection of almost two-thirds of the drum.

The grinder head 20 is formed from a frame 150 having a smart cylinder 26 that comprises a linear position sensor and actuators 152 which are mechanically linked. When a cylinder piston 154 is moved, the sensor measures the location of the piston 154 to provide precise control of a control arm 156 having a front section with wheels 160 for making precise positioning over the roadway possible. Incorporating a smart cylinder into the grinding head makes the precise positioning possible. The use of a screw actuator 162 can provide a precise ending point by continually verifying at 48 hertz to determine rotation, in this example the X rotation. For example, a screw actuator, even in that particular servo, will know it is turning in the X rotation, but a screw actuator will stop movement. By dithering back and forth at 499 to 501 thousandths, at 48 times a second, the screw actuator can be positioned at 500 thousandths.

By way of example, the space in between a skip is managed by maintaining support wheels 160 in contact with the pavement surface at all times, and by use of the actuator 152 linked to the control arm 156. By the cylinder 154 pushing down on the control arm 156, the wheels 160 are adjusted, allowing the grinder to articulate over the surface. The cylinder has no other linkage; the position of the piston 154 within the cylinder 26 is the precise position of the wheels 160 in relation to the grinder. A secondary linear encoder is a 12-volt screw type actuator that will measure the depth of the cut. Managing the depth in real time provides precise control. A pivot point #? is moved to an end of the grinder head, wherein the head can articulate, lift and tilt. With the pivot point in this position, the angle of the wheels can change without placing the grinder head at an angle. The lower pivot point allows the grinder head to manage the cut profile even while in the turn.

Figure 26:
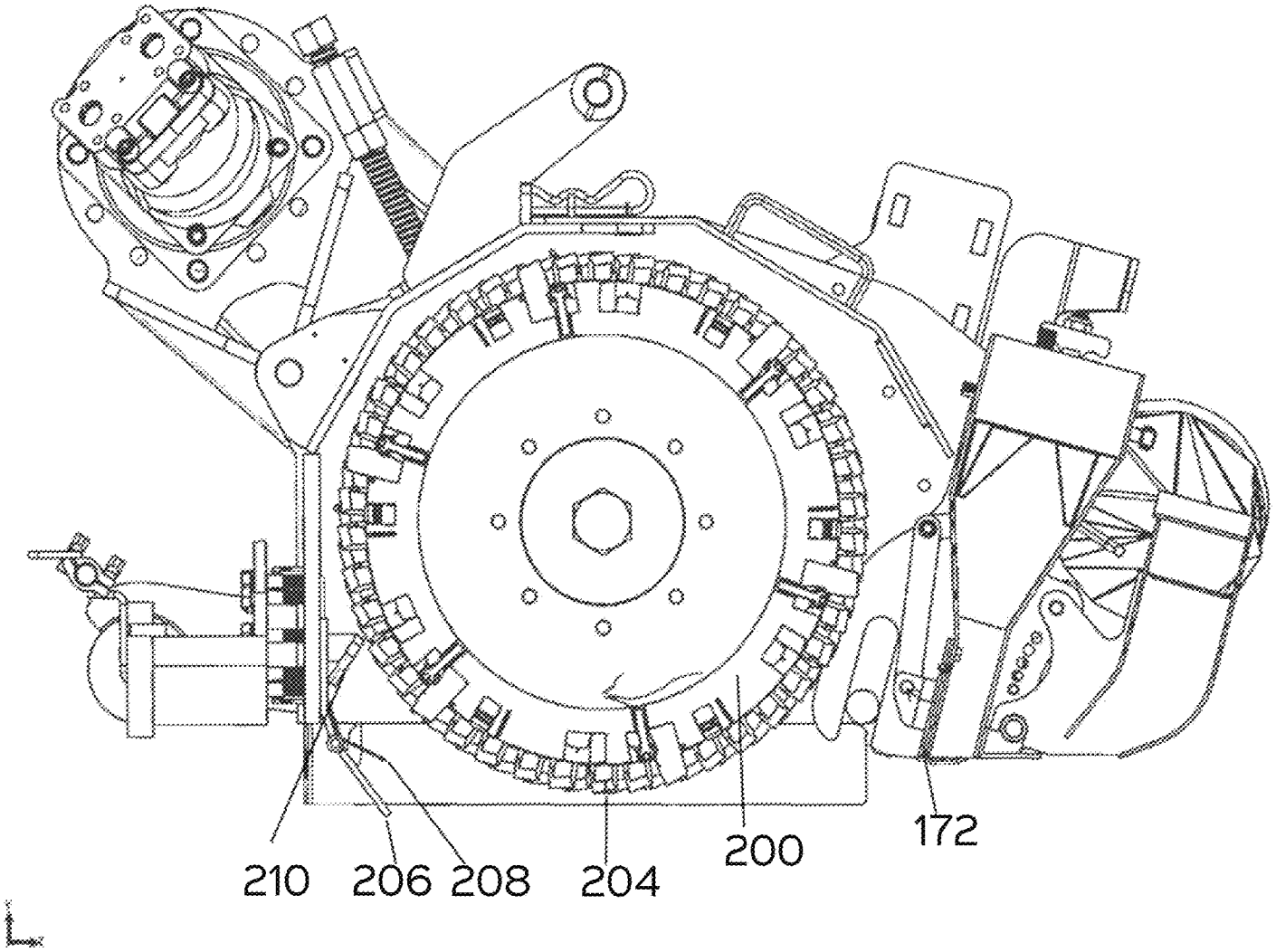
FIG. 26 is a cross sectional side view of the grinder.
Figure 27:
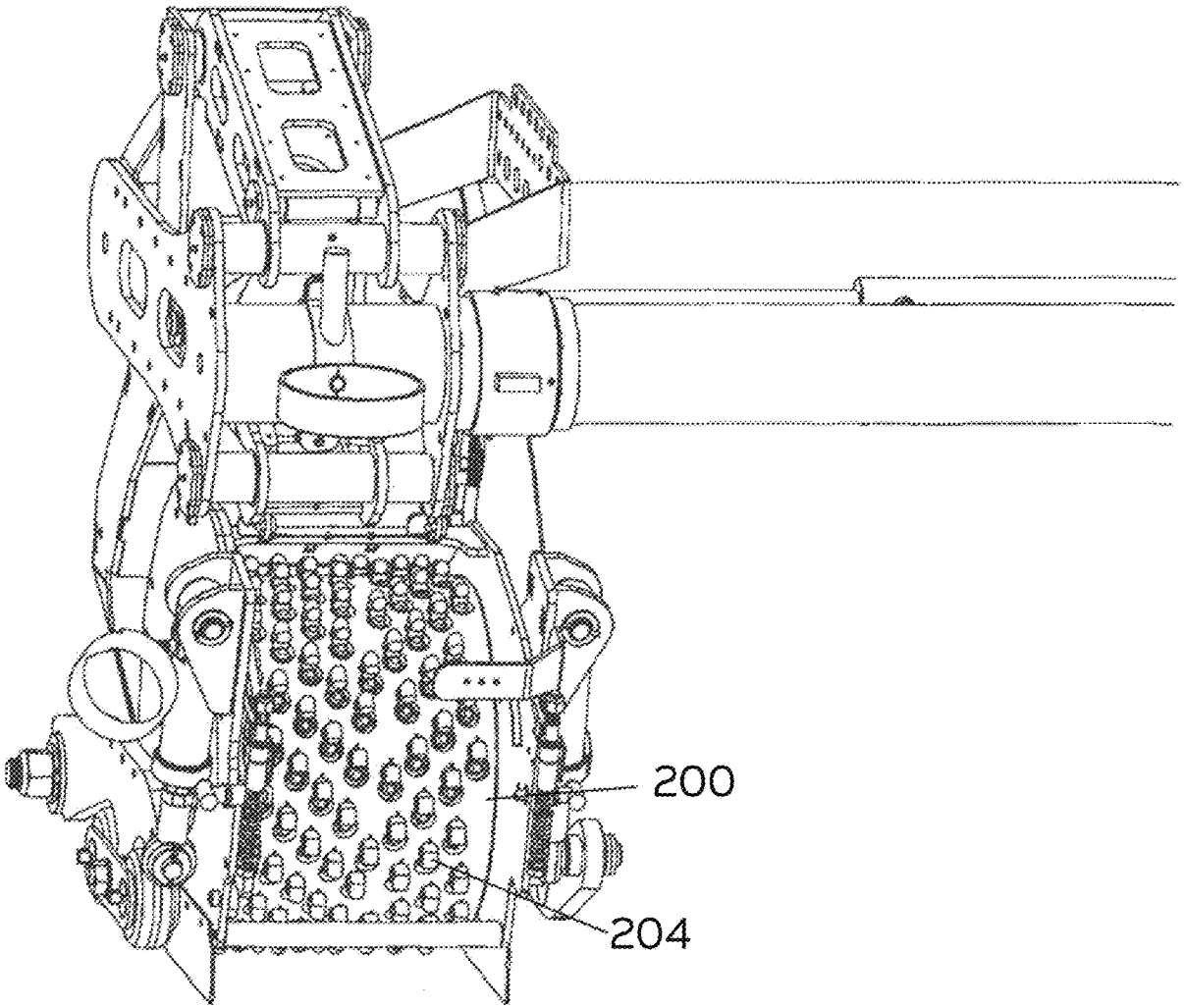
FIG. 27 is a rear perspective view of the grinder with shields removed.
Figure 28:
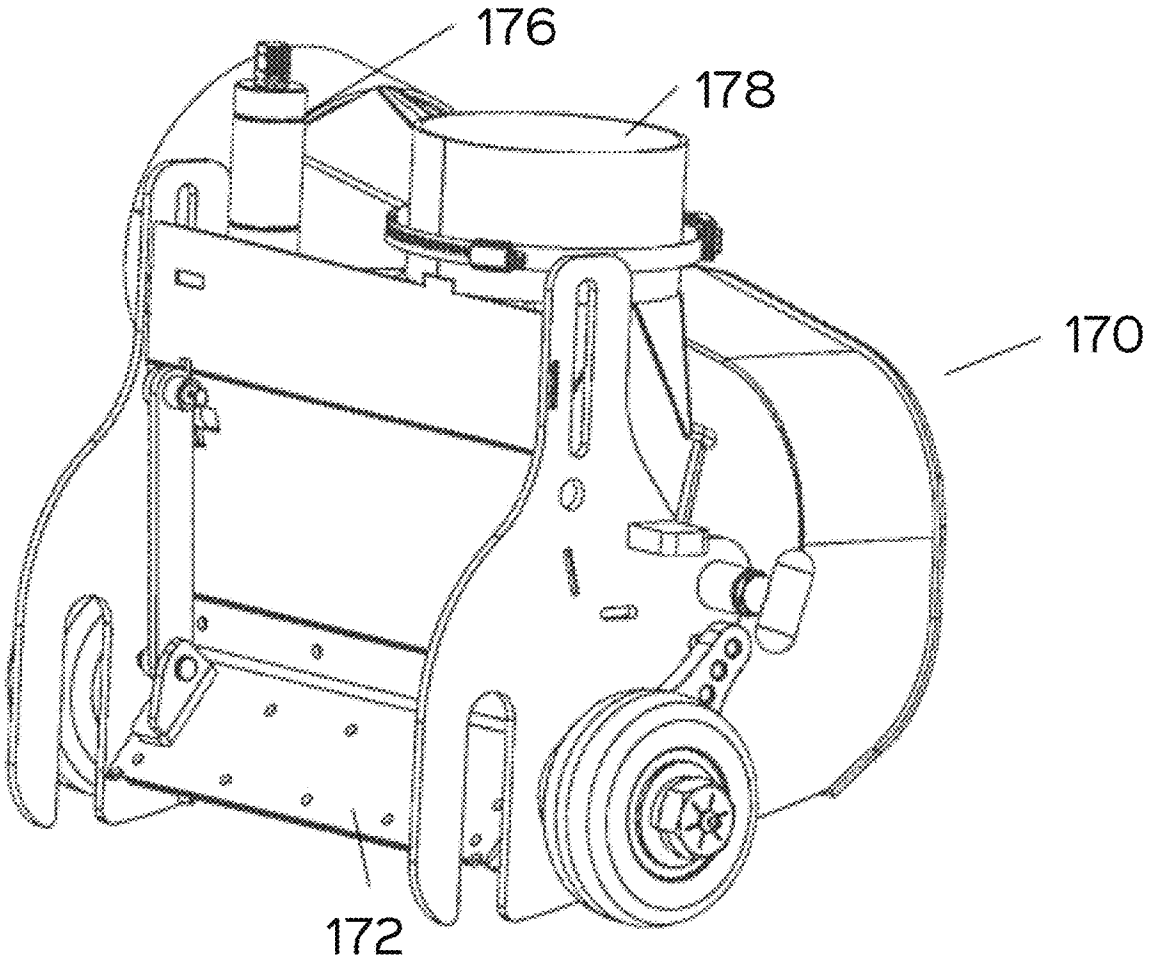
FIG. 28 is a front perspective view of a reflector flipper.

Each grinder head 20, 30 has a configuration that allows for the ability to expose two-thirds of the teeth for ease of maintenance. The grinding teeth can be inspected without the use of tools by use of a single articulating link 210 at the front of the grinder head 20, 30. The link allows access to the grinder head base 200, as illustrated in FIGS. 26 and 27, by removal of shields 202 for ease of inspecting and changing of teeth 204. The grinder head extends from the truck using two bolts. Upon removal of the bolts, the hydraulics can be disconnected to allow interchangeable heads with minimal effort. Debris door 206 is pivotally attached and spring loaded 208 to allow materially preventing material ejection during the grinding operation. Sizing plate 210 prevents large material from passing the sizing plate. The sizing plate 210 assures the material is ground to a predetermined size.

Figure 29:
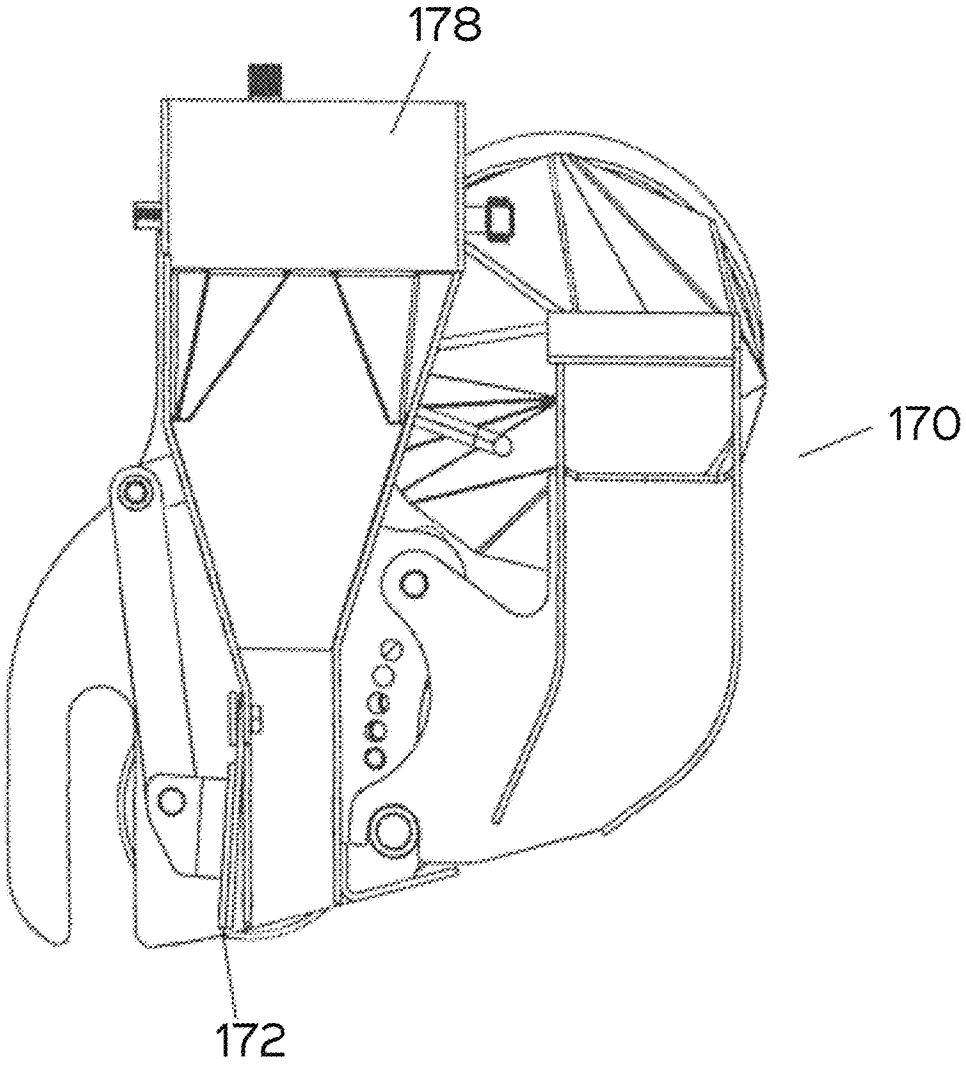
FIG. 29 is a side view of the reflector flipper.
Figure 30:
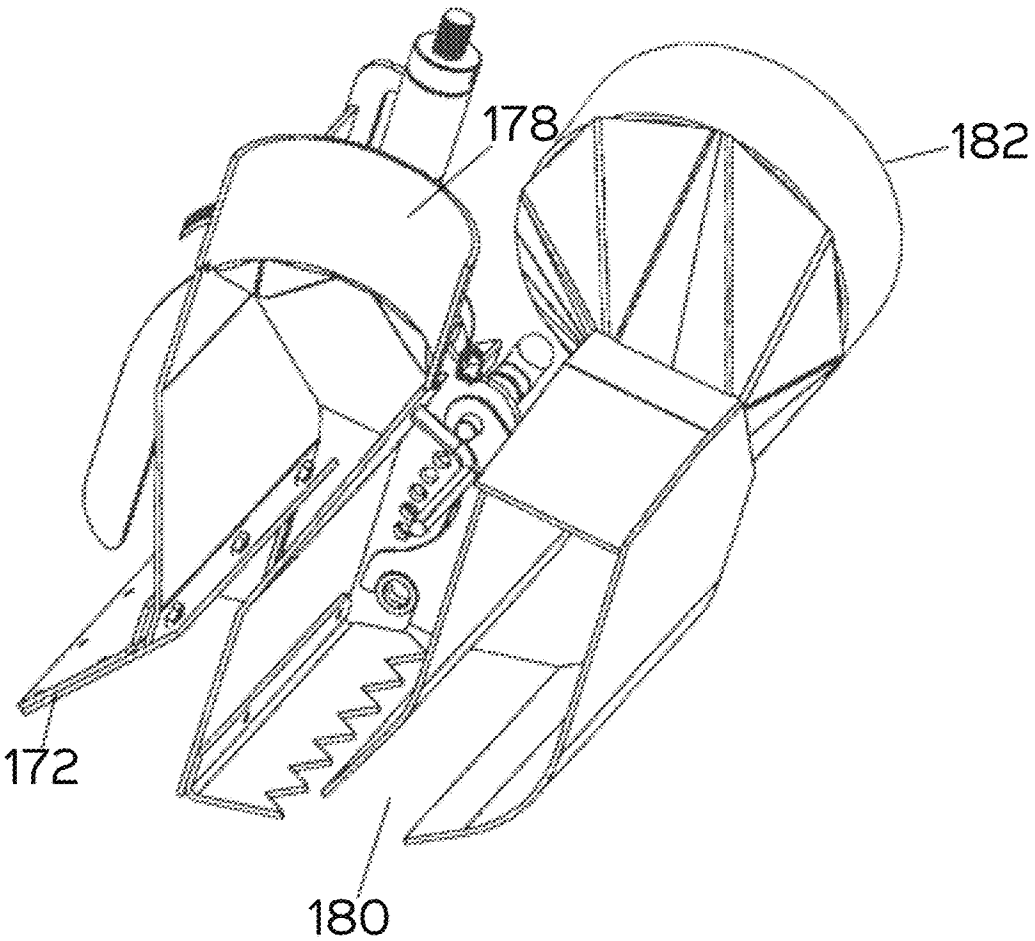
FIG. 30 is a cross sectional side view of the reflector flipper.
Figure 31:
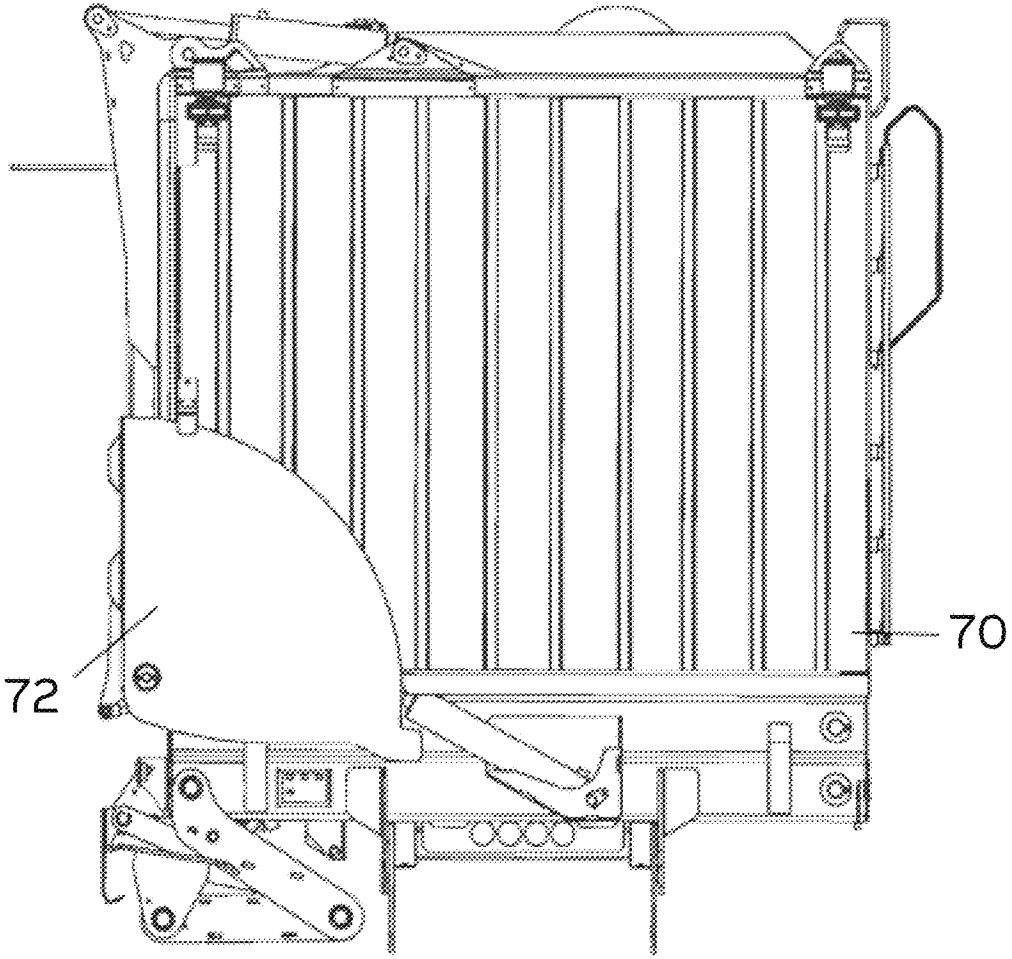
FIG. 31 is a side view of a scissor dump.
Figure 32:
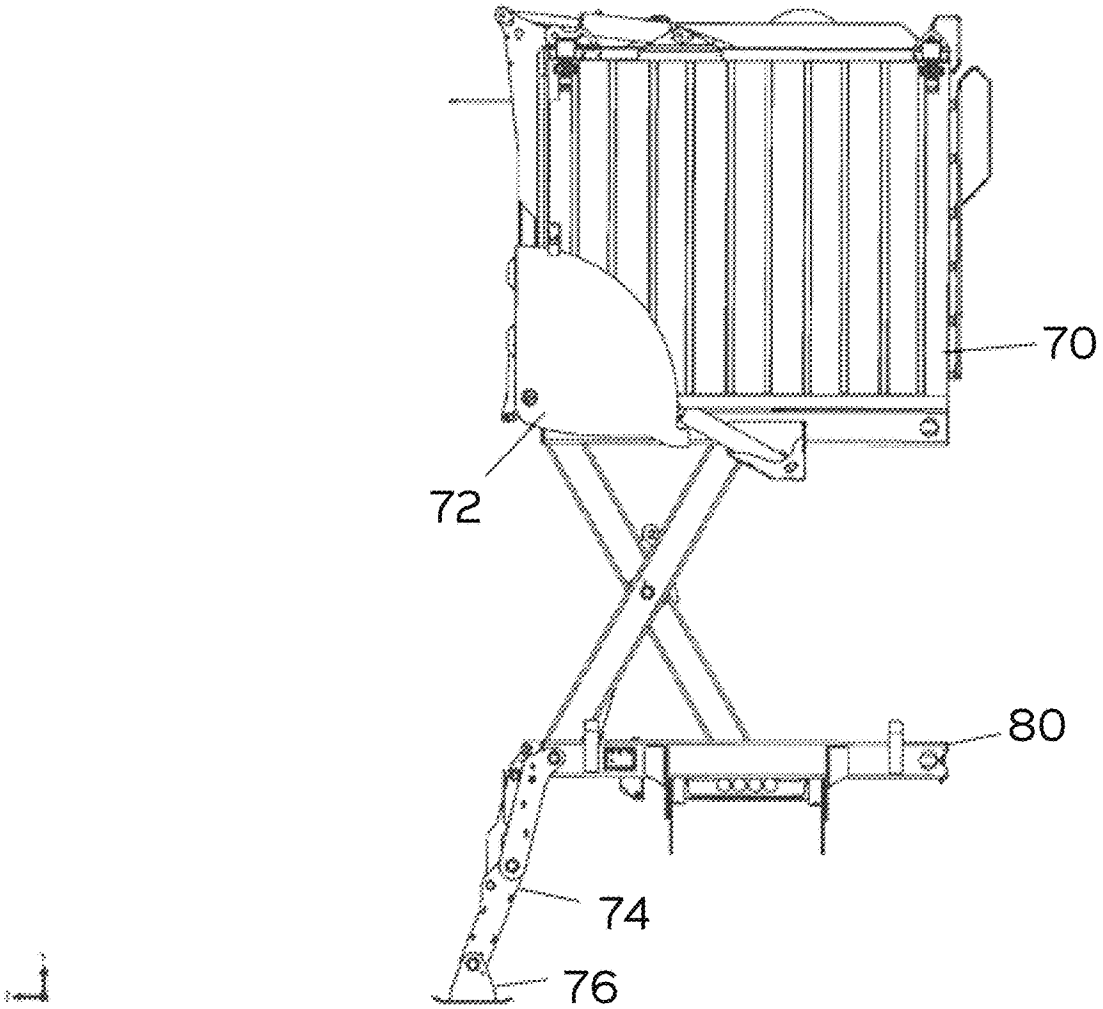
FIG. 32 is a side view of a scissor dump in a raised position with a closed chute.
Figure 33:
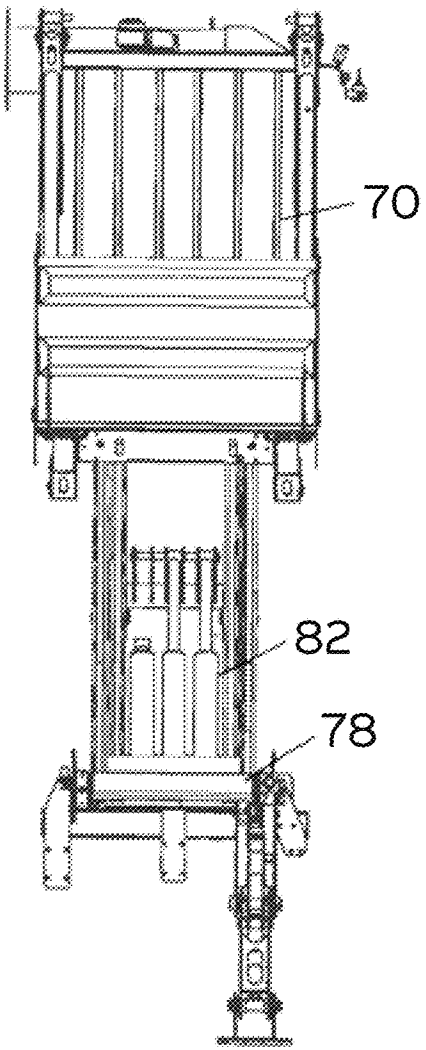
FIG. 33 is a front view of the scissor dump in the raised position with a closed chute.

A reflector popper-upper 170 employs a pulsated clearance door 172. The computer controls the pulse links and the timing between each pulse. The pulsated clearance door 172 is for on the vacuum head that allows reflectors to be sucked up, yet maintain a close clearance to the road surface. A pneumatic actuator 176 is computer controlled, the pulse is linked, and the distance between the pulses is timed. If a marker is stuck, the clearance door 172 is timed to open and the marker is sucked into the unit. When the clearance door 172 is closed, a marker will be popped off the roadway and dragged in front of the clearance door 172. When the clearance door 172 is opened, the marker is pulled into the unit by the vacuum head attachment 178. When the clearance door 172 is closed, such as in FIG. 29, the vacuum pressure is maintained and vacuum head attachment 178 is closed. When the clearance door 172 is open, such as in FIG.

30, the air velocity is at its highest level and the marker is immediately sucked into the unit. The quick opening of the clearance door essentially flicks the marker, allowing the vacuum to attach to the marker while the marker has no adhesion to the roadway. The reflectors, referred to as RPM's, are easily removed; however the bituminous material that they are put down with has elastomeric properties that can be as tough as leather to remove. The RPM's rip off and go wherever they can squeeze through. In this embodiment, road debris is drawn through a cavity 180 and into a continuous draw by coupling attachment 182 to a vacuum conveyor #?. Spring loaded shock absorbers 184 adjust for uneven roadway conditions.

Figure 34:
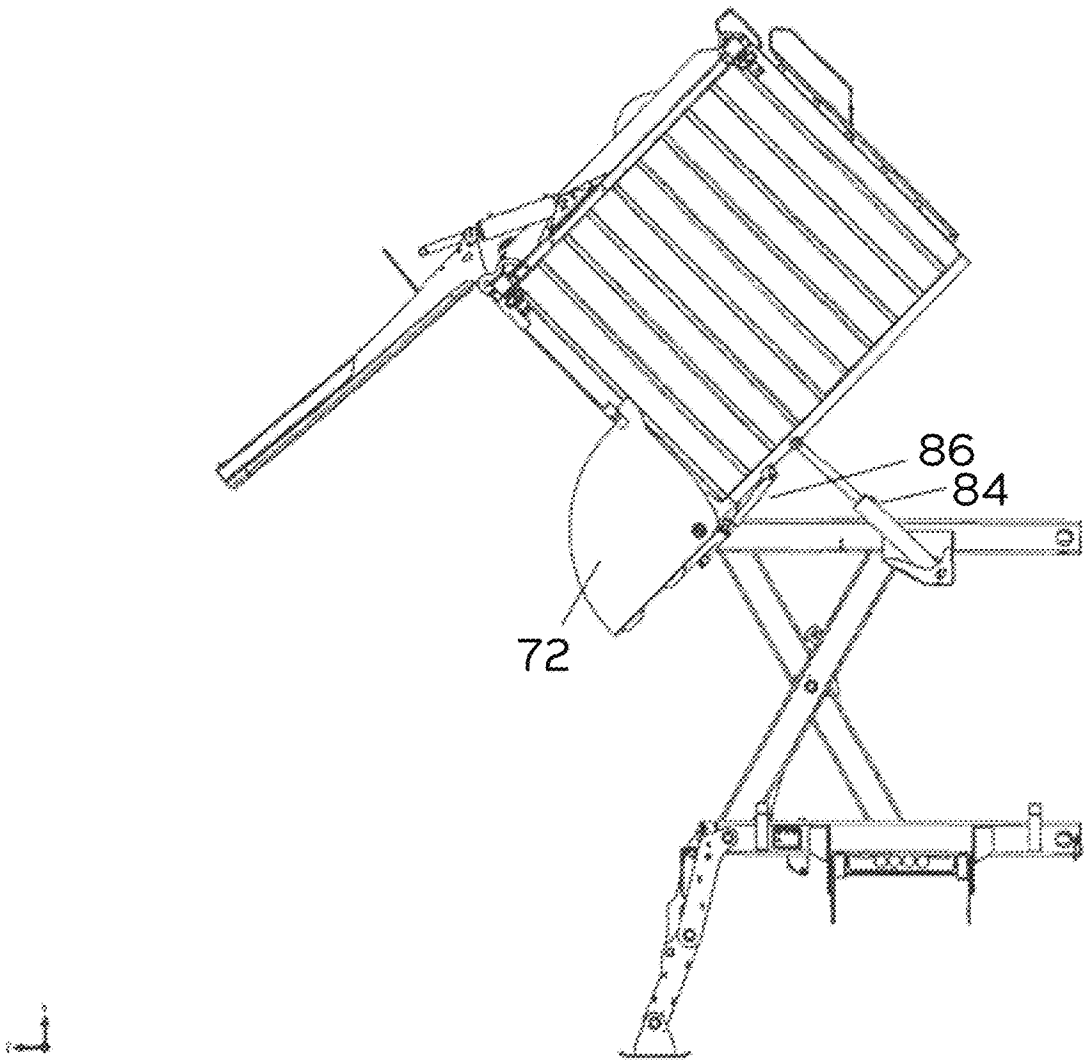
FIG. 34 is a side view of the scissor dump in the raised position with the chute open.

Referring to FIGS. 31-37, disclosed is the scissor dump #? that includes a chute 72 that is closed while the container 70 is raised. The chute 72 folds down and opens for dumping. The scissor dump employs a kickstand 74 that goes down automatically with the sequence valve, preventing opening unless the scissor dump is in position. In operation, when the scissor dump is activated, a foot 76 is lowered and is locked into position for stability. A sequence valve 78 then feeds a lifting mechanism 82 until the dump is fully raised; the sequence valve then switches to a dumping position which tilts the container 70, as depicted in FIG. 34, with an actuator 84 to cause the tilt and actuator 86 to open the chute 72.

Figure 35:
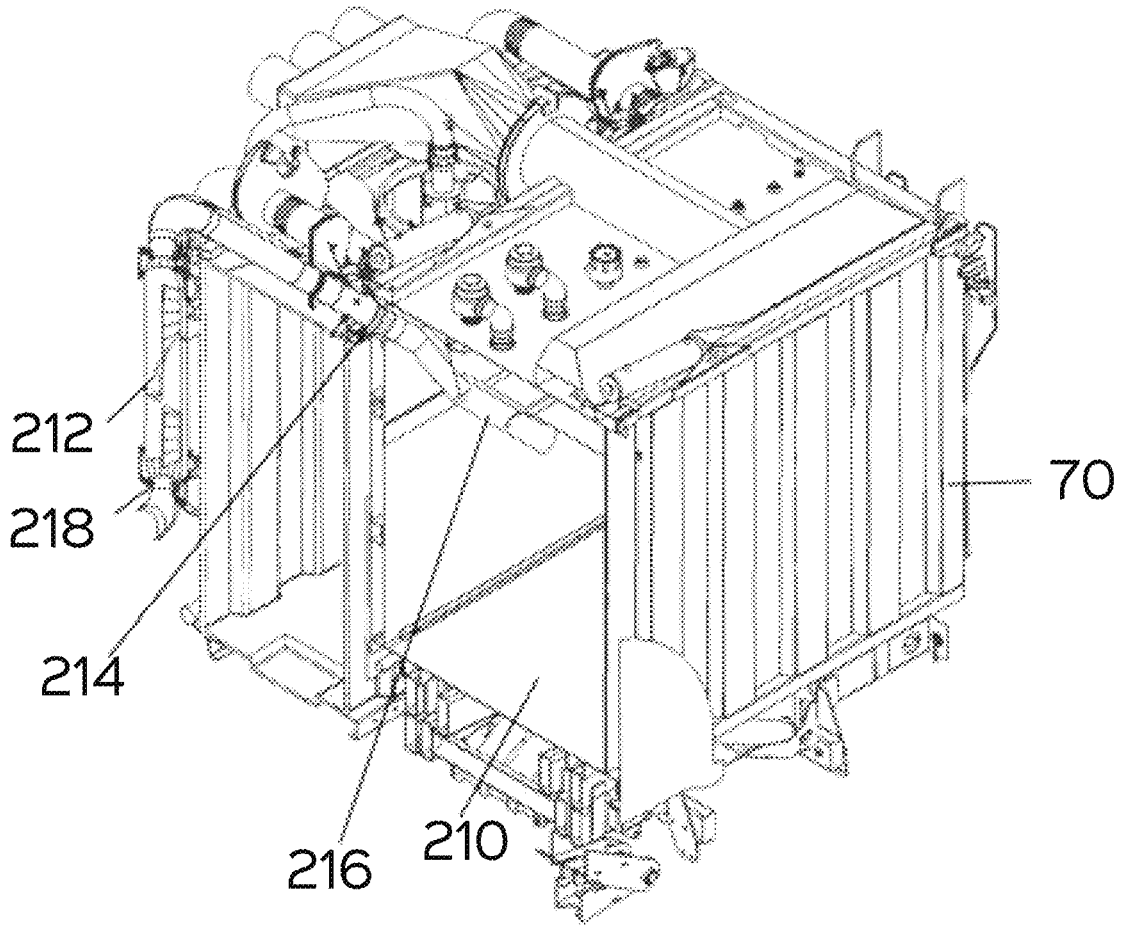
FIG. 35 is a front view of the scissor dump entrance.
Figure 36:
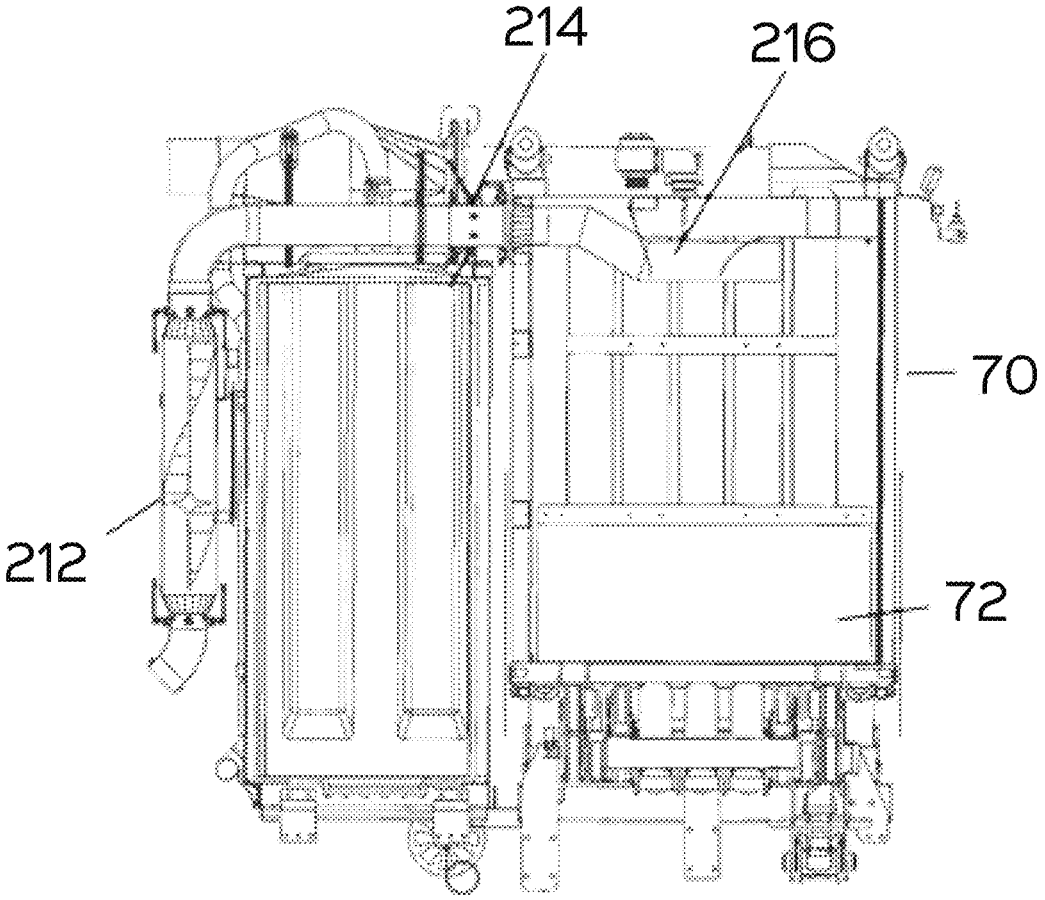
FIG. 36 is a perspective view of the scissor dump entrance.

The grinder truck 10 incorporates a high negative pressure and water mixology at the entrance into the vacuum tank 60. In a preferred embodiment, the entrance is a flexible tube 216 that flexes in response to the high negative pressure, resulting in mixing and self clearing of the flexible pipe; the water providing dust control and the flexing of the pipe. FIG. 35 is a front view of the scissor dump entrance 210 to the container 70 having a mixing chamber 212 with fluid induction 214 directly before the flexible tube 216. The flexible tube is constructed and arranged to purge itself of debris; the water limiting the dust. Water may also be inserted at a point 218 before the mixing chamber 212 if the mixing chamber is self cleaning.

In another embodiment, a vacuum conveyor is used to convey materials using high negative pressure without the use of a vacuum tank. The vacuum conveyor consists of a large cyclonic separator 50 fed by rotary lobe high vacuum blowers 40. Attached to the bottom of the separator is a rotating airlock 190 containing three stainless steel sections. The stainless steel sections are supported by three rubber ends that make contact with the walls and sides of this device. As the lobes rotate via a hydraulic cylinder, incoming debris falls into one of the chambers. When that chamber reaches the bottom, the debris falls out of a large hole in the separation chamber. As the lobes rotate, they accept incoming debris; and in the meantime, seal the unit from sucking backwards up through the chamber.

Unique to this vehicle is the debris collection system. Most machines have a vacuum tank and a blower that produce negative pressure within a tank for collecting the debris directly into the vacuum tank. Such machines have a vacuum blower system that requires a vacuum tank built to withstand high negative pressure. The vacuum blower has very fine tolerances, and cannot have any dirt going through it; and thus requires a fairly large air filter. Because a filter is required, a vacuum tank that is large enough to promote debris and air dropout is required so that the air filter is not instantly clogged. Further, once water and debris are in the tank, it is very difficult to remove because the tank is under tremendous negative pressure.

In a preferred embodiment, using the instant fan system, debris travels directly through the blades and blows out the other side. The tolerances inside this fan are very large and capable of passing stones, rocks and other types of debris typically picked up inside the cleaning head that can play havoc with a vacuum system. From the head to the fan, suction from the fan to the debris dewatering cage is provided. Once the debris and water are in the dewatering cage, they are not under vacuum and are easily pumped and transferred to other locations, such as filters for cleaning the water sufficiently to be reused again. The instant invention has a fan and dewatering bag with two pumps, one at 7,000 psi and another one that produces 40,000 psi. By changing a head unit, connecting a high-pressure hose, and connecting hydraulic hoses that run the 7,000 psi pump, this allows the operator to run 40,000 psi and up to 2½ gallons per minute. The higher pressure is ideal for removing traffic lines in parking stalls or around gate areas at airports.

Figure 37:
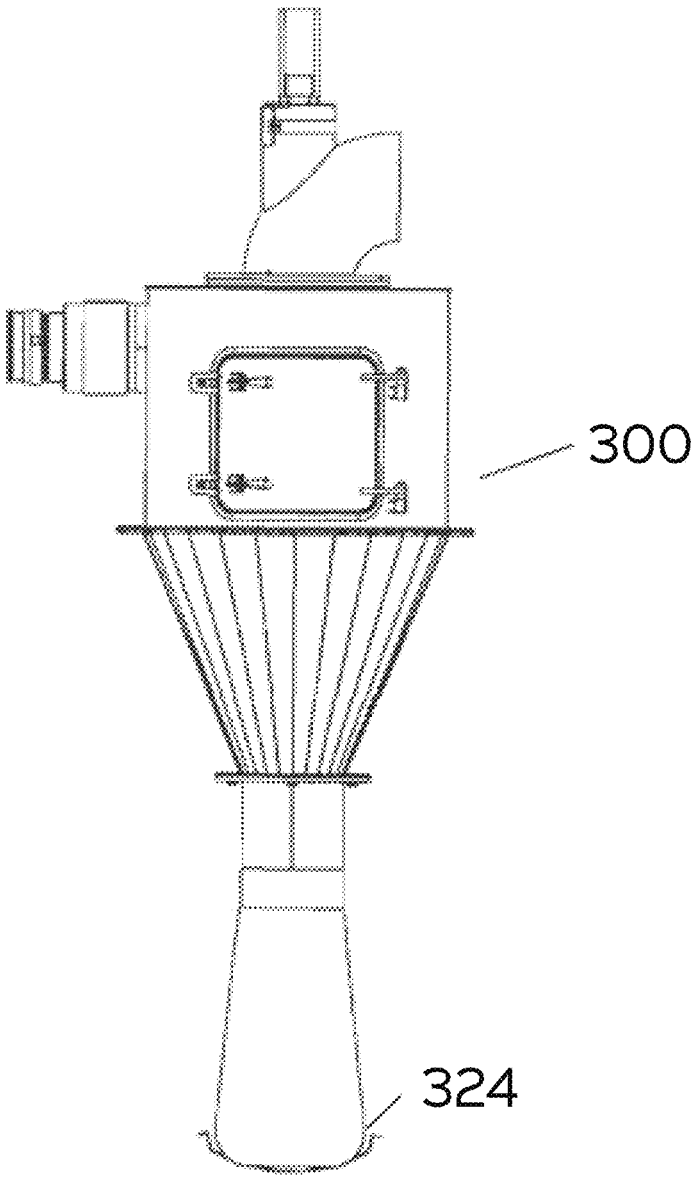
FIG. 37 is a front view of an alternative embodiment for a cyclone separator.
Figure 38:
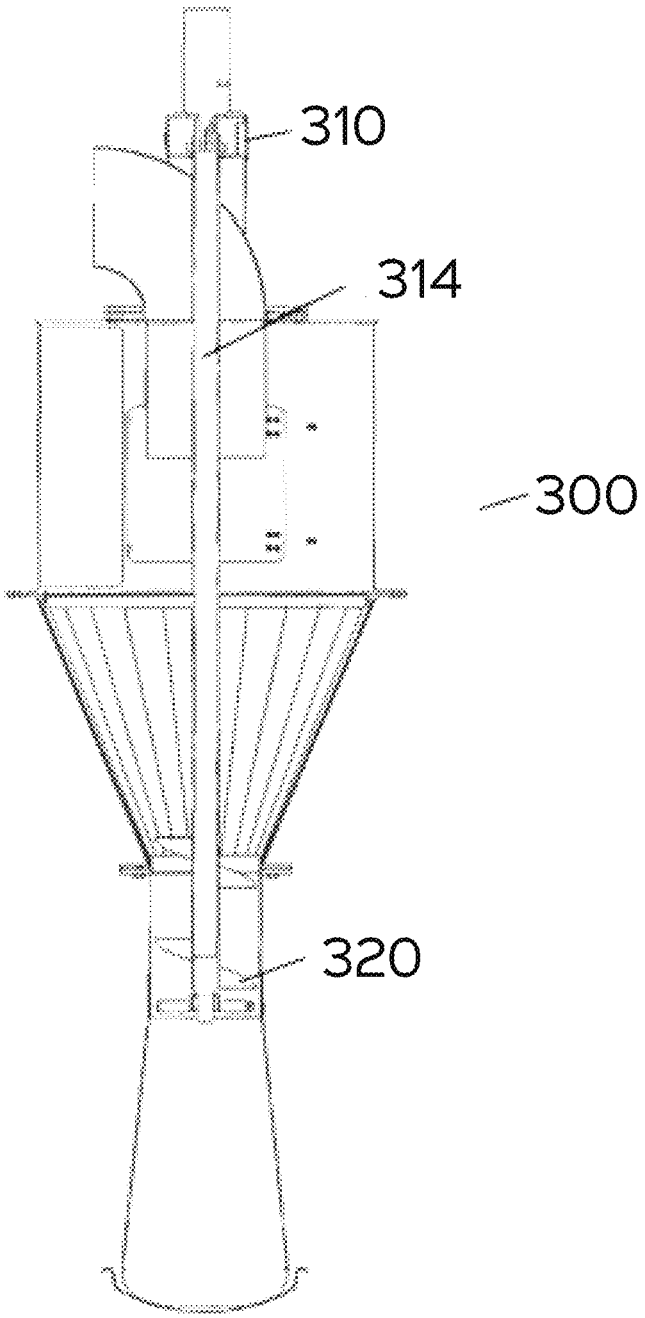
FIG. 38 is a cross sectional side view thereof.
Figure 39:
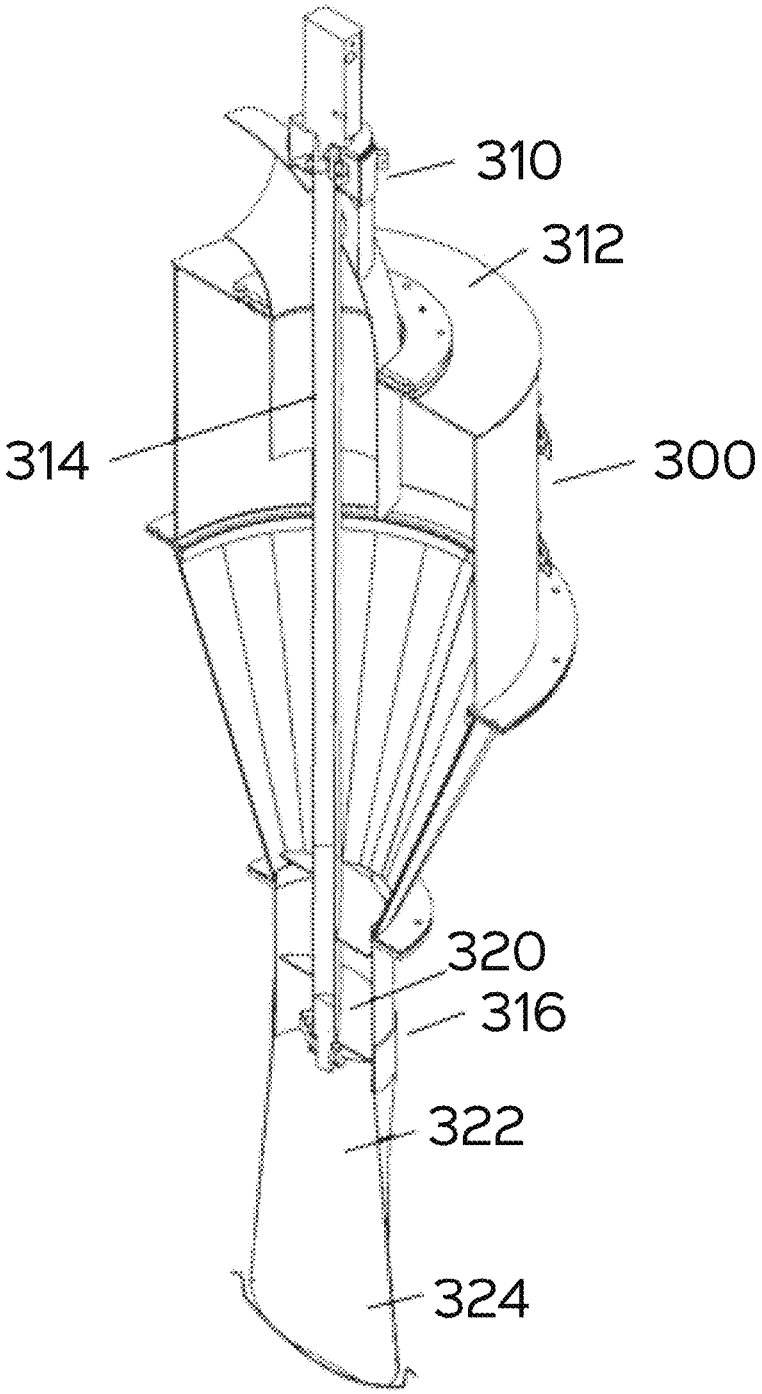
FIG. 39 is a perspective view thereof.

Referring to FIGS. 37-39 in an alternative embodiment, the device starts with a cyclone separator 300 in the same manner as above with a hydraulic motor 310 on the top 312 of the cyclone with a vertical shaft 314 extending into the bottom 316 of the separator. The vertical shaft 314 carries with it a short piece of auger 320 that extends for about six inches down the final throat 322 where the debris is coming out. Attached to the final throat is a short piece of flexible blue discharge hose 324. When the vacuum is running, the discharge hose is easily sucked shut, thereby preventing unwanted air from entering the bottom and of the cyclone and promoting air pulling the debris from wherever the debris is coming from. As the debris comes into the cyclone chamber and begins to fill it, the debris drops into the flexible discharge hose. Once the hose is full, the hose begins to relax. Once the debris fills up a little further, that auger turning forces the hose open and causes the debris to be discharged. The instant that the debris has been discharged, incoming air sucks the hose closed again and the hose operates as a valve. Sucking debris into the vacuum tanks is undesirable because the vacuum tanks become full and requires a place to dump the debris. For instance, the placement of rumble strips is acceptable in a small line along the side of the road. However, a large load of markings alongside the road in one spot would not be allowed. Similarly, for hydro excavation work, a hole dug for a telephone pole with air and suction would not pose a problem if the dirt was scatter around the hole. However, if 10 or 15 holes are opened, resulting in a truck full of dirt, then the truck must travel before you dump it.

Figure 40:
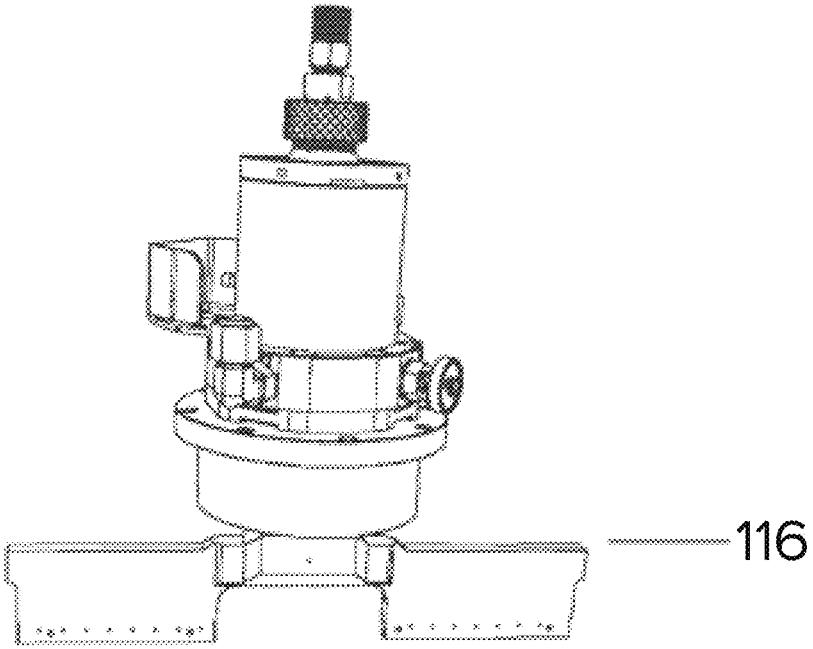
FIG. 40 is a perspective view of the debris mixer.
Figure 41:
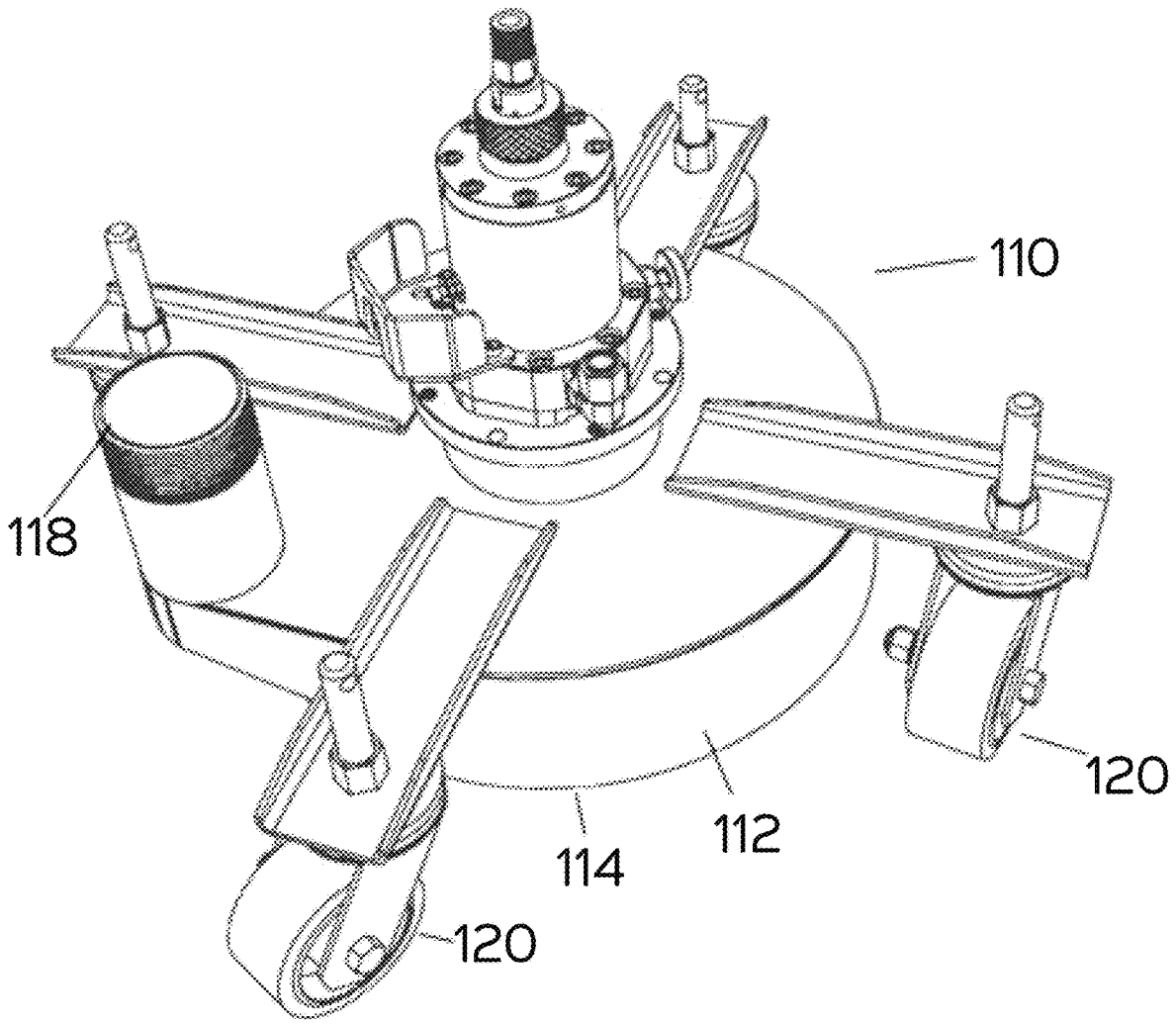
FIG. 41 is a perspective view of the debris mixer shroud.

Referring to FIGS. 40 and 41, an alternative debris remover 110 employs a shroud 112, providing a substantially circular shape for following of a grinder head 20, 30. The shroud 112 includes a seal or brush around a perimeter 114 to provide a flexible seal between the shroud and the roadway. The shroud encompasses a blade mixer 116 that is rotated within the shroud at such a speed so as to cause any debris materials within the shroud to be suspended in air. A vacuum attachment 118 draws the suspended material into a transfer line for placement into the container 70. Wheels 120 positioned around the shroud maintain the lower edge perimeter 114 a fixed distance from the surface to be cleaned. The shroud eliminates the need for a direct draw of material by use of a vacuum, allowing vacuum to draw upon the suspended debris.

In another embodiment, a vehicle has a cleaning machine incorporating two pumps; one low pressure pump around 2,000 to 8,000 psi, and another high pressure unit between 30,000 and 40,000 psi. The subject of this application would be the cleaning of asphalt or concrete surfaces. For instance, at an airport, both concrete and asphalt surfaces get dirty from a wide variety of substances. Mildew, sand, dirt, grease, oil, and tire marks all serve to make up some of the items that can provide unsightly and environmentally unfriendly substances. The cleaning machine is designed to remedy these dirty surfaces. If surfaces around gate areas are not cleaned, the oil and grease from baggage handling machines, refueling trucks, and deicing trucks, as well as the airplanes themselves, leave a marred surface over time. Heavy rains carry the hydrocarbons from these fluids into the storm drains, which will contaminate the surrounding waterways. Similarly, gas stations and refueling stops suffer the same reality. In other places, asphalt simply becomes clogged with dirt and mildew over time, and eventually fails to drain. The surface cleaning machine incorporates a high-pressure pump, a suction device, a clean water tank, a debris and dirty water filtering tank/system, and a low pressure pump that pumps the dirty water back through a series of filters directly back into the clean water tank, thus providing for recycling. During this process, the water is also pumped through cyclonic filters designed to remove any solids in the water and deposit back into the debris tank itself. The unit produces between 5,000 and 8,000 psi, and between 4 gallons and 8 gallons per minute. The cleaning unit is attached to a vehicle and is between 12 to 72 inches, preferably 36 inches.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

One skilled in the art will readily appreciate that the present invention is well adapted to carry out the objects and obtain the ends and advantages mentioned, as well as those inherent therein. Any compounds, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A multi-purpose grinder for use with a grinder truck comprising:

a grinder head having a plurality of carbide coated or diamond coated cutting teeth rotatably secured to the grinder truck;

a rotary encoder is attached to a wheel of the grinder truck in an x position to control the x position of said grinder head;

a vertical cylinder unit securing said grinder head to the grinder truck in a y position to control the up/down y position of said grinder head;

a horizontal cylinder unit securing said grinder head to the grinder truck in a z position to control the left/right z position of said grinder head;

a computer controller secured to each said cylinder, said computer controller electrically coupled to a plurality of encoders constructed and arranged to detect the position of said grinder head in the x, y and z position; and a display screen electrically coupled to said computer controller for displaying and inputting adjustment to each said cylinder, said computer controller programmed with a plurality of pre-set moves, said pre-set moves allow a tap of said display screen to position move said grinder head, said display screen includes a cross-hair alignment screen to allow an operator to position a contrast sensor camera directly over a drip line or an expansion joint.

2. The multi-purpose grinder according to claim 1 wherein said rotary encoder determines said linear x position of the grinder truck by detecting wheel rotation.

3. The multi-purpose grinder according to claim 1 wherein said z position is detected by said contrast sensor camera.

4. The multi-purpose grinder according to claim 1 wherein said tap on said display screen moves said grinder head ⅛".

5. The multi-purpose grinder according to claim 1 wherein said computer controller instructs said grinder head to move in predetermined patterns or profiles.

6. The multi-purpose grinder according to claim 5 wherein said pattern is further defined as a plunge cut to form a receptacle for a road marker.

7. The multi-purpose grinder according to claim 1 wherein each said cylinder is further defined as a slide cylinder with positional feedback.

8. The multi-purpose grinder according to claim 2 wherein said rotary encoder reassigns said grinder head to a master position.

9. The multi-purpose grinder according to claim 1 wherein said computer controller can incrementally move said grinder in either said x, y, or z position by use of a position input.

10. The multi-purpose grinder according to claim 9 wherein said computer controller detects a zero point, said zero point defined as the position where a cutting tooth touches pavement, said computer controller allowing adjustment of said zero point by position input.

11. The multi-purpose grinder according to claim 1 including a remote controller coupled to said computer controller, said remote controller provides computer controller input from a location separate from computer controller.

12. The multi-purpose grinder according to claim 1 including a screw actuator to provide a precise ending point and by operating said screw actuator at about 48 hertz to determine rotation for continually verifying said ending point.

* * * * *